US011381003B2

(12) United States Patent
Omuro et al.

(10) Patent No.: US 11,381,003 B2
(45) Date of Patent: Jul. 5, 2022

(54) ANTENNA DEVICE

(71) Applicant: Sony Corporation, Tokyo (JP)

(72) Inventors: Tomihiro Omuro, Tokyo (JP); Yuichiro Suzuki, Tokyo (JP); Takayoshi Ito, Tokyo (JP); Toru Ozone, Tokyo (JP); Jin Sato, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/962,854

(22) PCT Filed: Oct. 17, 2018

(86) PCT No.: PCT/JP2018/038662

§ 371 (c)(1),
(2) Date: Jul. 17, 2020

(87) PCT Pub. No.: WO2019/146183

PCT Pub. Date: Aug. 1, 2019

(65) Prior Publication Data

US 2020/0350699 A1 Nov. 5, 2020

(30) Foreign Application Priority Data

Jan. 26, 2018 (JP) ..... JP2018-011301

(51) Int. Cl.
*H01Q 21/24* (2006.01)
*H01Q 19/00* (2006.01)
(Continued)

(52) U.S. Cl.
CPC ..... *H01Q 19/005* (2013.01); *H01Q 13/08* (2013.01); *H01Q 19/02* (2013.01); *H01Q 21/06* (2013.01);
(Continued)

(58) Field of Classification Search
CPC .... H01Q 21/065; H01Q 21/08; H01Q 19/005; H01Q 3/446
See application file for complete search history.

(56) References Cited

U.S. PATENT DOCUMENTS 620,464 A 2/1899 Leen
4,700,197 A * 10/1987 Milne ..... H01Q 3/446 343/837
(Continued)

FOREIGN PATENT DOCUMENTS

EP 3 255 730 A1 12/2017
JP 2002-163762 A 6/2002
(Continued)

OTHER PUBLICATIONS

Extended European Search Report dated Dec. 10, 2020, in corresponding European Patent Application No. 18901959.9.
(Continued)

*Primary Examiner* — Ab Salam Alkassim Jr.
(74) *Attorney, Agent, or Firm* — Xsensus LLP

(57) ABSTRACT

An antenna device including: a substrate; a plurality of antenna elements supported by the substrate, each of the antenna elements having a feeding point; and a parasitic element supported by the substrate and having no feeding point, in which the plurality of antenna elements is disposed to be spaced apart from each other along a predetermined direction, the parasitic element is mutually spaced apart in the direction from a first antenna element located on an end side in the direction among the plurality of antenna elements, and a first element interval between the parasitic element and the first antenna element is equal to or less than twice a second element interval between the first antenna
(Continued)

element and a second antenna element located on an opposite side of the parasitic element with respect to the first antenna element.

14 Claims, 20 Drawing Sheets

(51) Int. Cl.
*H01Q 13/08* (2006.01)
*H01Q 19/02* (2006.01)
*H01Q 21/06* (2006.01)
*H01Q 21/08* (2006.01)

(52) U.S. Cl.
CPC ..... *H01Q 21/065* (2013.01); *H01Q 21/08* (2013.01); *H01Q 21/24* (2013.01)

(56) References Cited

U.S. PATENT DOCUMENTS 6,456,242 B1 9/2002 Crawford
9,620,464 B2 * 4/2017 Baks ..... H01Q 19/10
10,476,149 B1 * 11/2019 Ueda ..... H01Q 5/385
10,573,974 B2 * 2/2020 Rowell ..... H01Q 19/005
10,637,154 B2 * 4/2020 Xian ..... H01Q 21/061
2005/0078046 A1 * 4/2005 Theobold ..... H01Q 1/246 343/797
2008/0122728 A1 * 5/2008 Philippakis ..... H01Q 19/32 343/876
2012/0027056 A1 * 2/2012 Shinkai ..... H01Q 3/44 375/219
2013/0050056 A1 * 2/2013 Lee ..... H01Q 9/0407 343/893
2013/0147664 A1 6/2013 Lin
2014/0368395 A1 * 12/2014 Dauguet ..... H01Q 21/24 343/798
2015/0180116 A1 6/2015 Sato et al.
2015/0340770 A1 * 11/2015 Loh ..... H01Q 3/446 343/833
2016/0049723 A1 * 2/2016 Baks ..... H01Q 1/2291 343/848
2016/0061983 A1 * 3/2016 Heikura ..... H01Q 1/243 324/207.15
2016/0365632 A1 * 12/2016 Lee ..... H01Q 9/0442
2017/0352944 A1 * 12/2017 Komulainen ..... H01Q 1/38
2018/0331432 A1 * 11/2018 Kawaguchi ..... H01Q 19/005
2019/0013590 A1 * 1/2019 Rowell ..... H01Q 3/267
2019/0081414 A1 * 3/2019 Kao ..... H01Q 5/42
2019/0089052 A1 * 3/2019 Yong ..... H01Q 1/2283
2019/0207323 A1 * 7/2019 Joung ..... H01Q 1/526
2021/0066817 A1 * 3/2021 Tehran ..... H01Q 21/065
2021/0336337 A1 * 10/2021 Obeidat ..... H01Q 3/446

FOREIGN PATENT DOCUMENTS

JP 2002-374121 A 12/2002
JP 2005-072653 A 3/2005
JP 2006-256359 A 9/2006
JP 2007-158707 A 6/2007
JP 2011-027703 A 2/2011
JP 2016-152590 A 8/2016
JP 2017-046107 A 3/2017
WO 2013/084585 A 6/2013

OTHER PUBLICATIONS

International Search Report and Written Opinion dated Dec. 18, 2018 for PCT/JP2018/038662 filed on Oct. 17, 2018, 9 pages including English Translation of the International Search Report.

* cited by examiner

ANTENNA DEVICE

CROSS-REFERENCE TO RELATED APPLICATIONS

The present application is based on PCT filing PCT/JP2018/038662, filed Oct. 17, 2018, which claims priority to JP 2018-011301, filed Jan. 26, 2018, the entire contents of each are incorporated herein by reference.

TECHNICAL FIELD

The present disclosure relates to an antenna device.

BACKGROUND ART

In a mobile communication system based on the communication standard called LTE/LTE-A (advanced), a wireless signal called an ultrashort wave with a frequency of 700 MHz to 3.5 GHz is mainly used for communication.

Furthermore, in the communication using an ultrashort wave like the communication standard described above, by adopting a technology called so-called multiple-input and multiple-output (MIMO), it is possible to further improve the communication performance by using a reflected wave in addition to a direct wave for transmitting and receiving signals even in a fading environment. Since a plurality of antennas is used in MIMO, various methods for disposing a plurality of antennas in a terminal device for mobile communication such as a smartphone and the like in a more preferred mode have been studied.

Furthermore, in recent years, various studies have been made on a fifth generation (5G) mobile communication system following LTE/LTE-A. For example, in the mobile communication system, the use of communication using a wireless signal called a millimeter wave with a frequency such as 28 GHz or 39 GHz (hereinafter, also simply referred to as "millimeter wave") has been studied.

CITATION LIST

Patent Document

Patent Document 1: Japanese Patent Application Laid-Open No. 2005-72653

SUMMARY OF THE INVENTION

Problems to be Solved by the Invention

In that connection, generally, a millimeter wave has relatively large spatial attenuation, and in a case where a millimeter wave is used for communication, there is a tendency for an antenna having a high gain to be required. To fulfill such a requirement, a technology called so-called beam forming may be used. Specifically, by controlling a beam width of an antenna by beam forming and improving directivity of the beam, it is possible to further improve the gain of the antenna. One example of an antenna system that can implement such control is a patch array antenna. For example, Patent Document 1 discloses one example of the patch array antenna.

Meanwhile, as a plurality of antenna elements is arrayed (for example, patch antenna), a distortion may occur in a radiation pattern of at least some of the antenna elements. In contrast, a method for inhibiting occurrence of such a distortion by providing a sufficiently large ground area can be cited. In this case, the size of the antenna device may become larger.

Therefore, the present disclosure proposes one example of a technology that enables miniaturization of a device in a more preferred mode in a case where a plurality of antenna elements is arrayed.

Solutions to Problems

According to the present disclosure, there is provided an antenna device including: a substrate; a plurality of antenna elements supported by the substrate, each of the antenna elements having a feeding point; and a parasitic element supported by the substrate and having no feeding point, in which the plurality of antenna elements is disposed to be spaced apart from each other along a predetermined direction, the parasitic element is mutually spaced apart in the direction from a first antenna element located on an end side in the direction among the plurality of antenna elements, and a first element interval between the parasitic element and the first antenna element is equal to or less than twice a second element interval between the first antenna element and a second antenna element located on an opposite side of the parasitic element with respect to the first antenna element.

Effects of the Invention

As described above, the present disclosure proposes a technology that enables miniaturization of a device in a more preferred mode in a case where a plurality of antenna elements is arrayed.

Note that above effects are not necessarily restrictive, and in addition to or instead of the effects described above, any of the effects indicated in the present specification or other effects that can be determined from the present specification may be produced.

MODE FOR CARRYING OUT THE INVENTION

Figure 1:
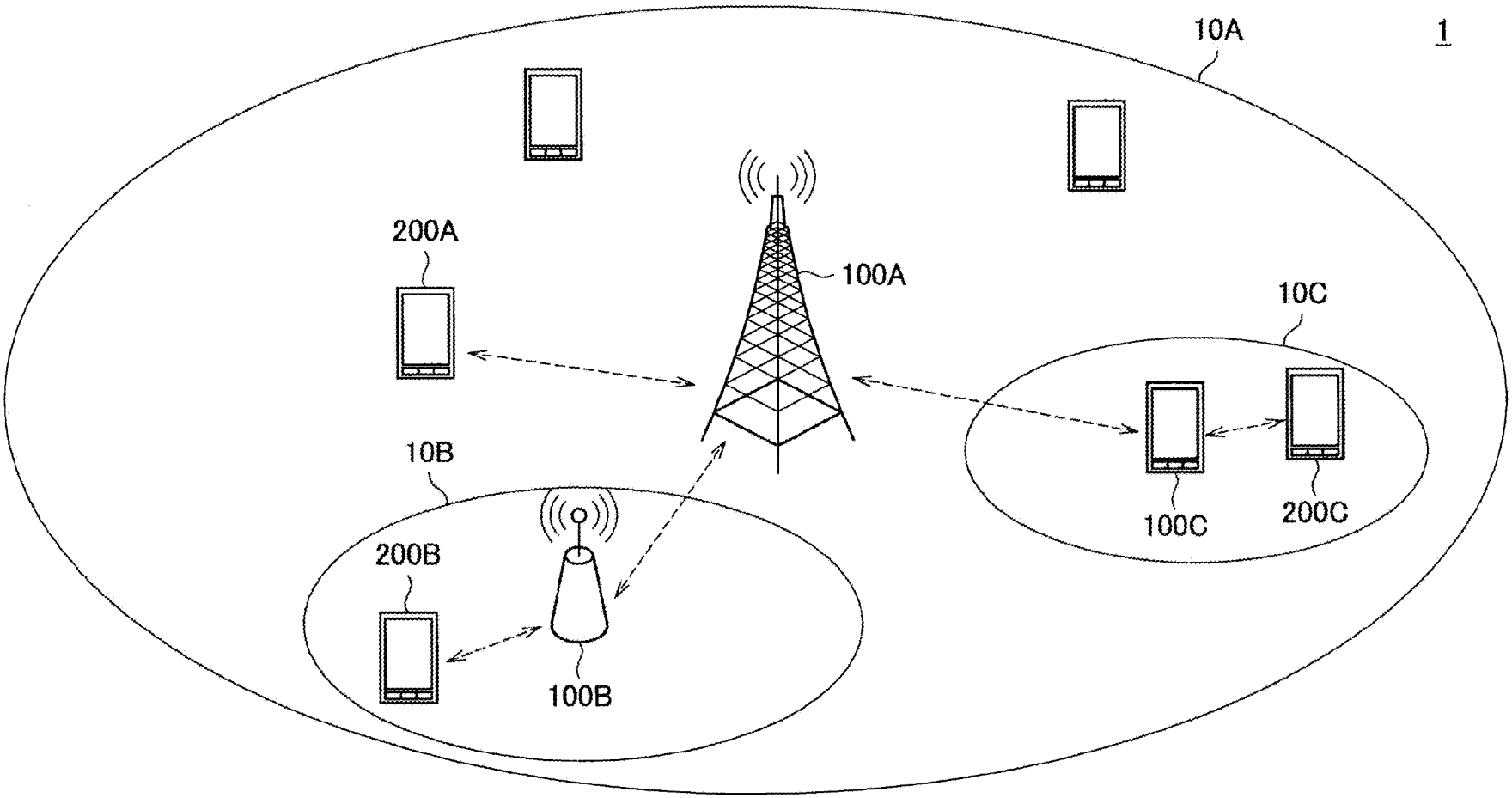
FIG. 1 is an explanatory diagram for describing one example of a schematic configuration of a system according to one embodiment of the present disclosure.

A preferred embodiment of the present disclosure will be described in detail below with reference to the accompanying drawings. Note that in the present specification and the drawings, components having substantially the same functional configuration are denoted with the same reference symbol, and redundant description thereof will be omitted.

Note that the description will be made in the following order.

1. Schematic configuration
1.1. One example of system configuration
1.2. Configuration example of terminal device
2. Overview of communication using millimeter wave
3. Configuration example of communication device assuming use of millimeter wave
4. Technical problem
5. Technical advantage
5.1. Configuration
5.2. Characteristics of antenna device
5.3. Modifications
5.4. Application example
6. Conclusion

1. SCHEMATIC CONFIGURATION

<1.1. One Example of System Configuration>

To begin with, with reference to FIG. 1, one example of a schematic configuration of a system 1 according to one embodiment of the present disclosure will be described. FIG. 1 is an explanatory diagram for describing one example of the schematic configuration of the system 1 according to one embodiment of the present disclosure. As shown in FIG. 1, the system 1 includes a wireless communication device 100 and a terminal device 200. Here, the terminal device 200 is also called a user. The user may also be called UE. The wireless communication device 100C is also called UE-relay. The UE here may be UE defined in LTE or LTE-A, the UE-relay may be prose UE to network relay discussed in 3GPP, more generally may mean a communication device.

(1) Wireless Communication Device 100

The wireless communication device 100 is a device that provides a wireless communication service to a subordinate device. For example, the wireless communication device 100A is a base station of a cellular system (or mobile communication system). The base station 100A performs wireless communication with a device located inside a cell 10A of the base station 100A (for example, terminal device 200A). For example, the base station 100A transmits a downlink signal to the terminal device 200A and receives an uplink signal from the terminal device 200A.

The base station 100A is logically connected to another base station by, for example, an X2 interface, and can transmit and receive control information and the like. Furthermore, the base station 100A is logically connected to a so-called core network (not shown) by, for example, an S1 interface, and can transmit and receive control information and the like. Note that communication between these devices can be physically relayed by various devices.

Here, the wireless communication device 100A shown in FIG. 1 is a macro cell base station, and the cell 10A is a macro cell. Meanwhile, the wireless communication devices 100B and 100C are master devices that operate the small cells 10B and 10C, respectively. As one example, the master device 100B is a fixedly installed small cell base station. The small cell base station 100B establishes a wireless backhaul link with the macro cell base station 100A, and establishes an access link with one or more terminal devices in the small cell 10B (for example, terminal device 200B). Note that the wireless communication device 100B may be a relay node defined by 3GPP. The master device 100C is a dynamic access point (AP). The dynamic AP 100C is a mobile device that dynamically operates the small cell 10C. The dynamic AP 100C establishes a wireless backhaul link with the macro cell base station 100A, and establishes an access link with one or more terminal devices in the small cell 10C (for example, terminal device 200C). The dynamic AP 100C may be, for example, a terminal device equipped with hardware or software that can operate as a base station or a wireless access point. In this case, the small cell 10C is a dynamically formed localized network/virtual cell.

The cell 10A may be operated according to an a wireless communication scheme such as, for example, LTE, LTE-A (LTE-advanced), LTE-ADVANCED PRO, GSM (registered trademark), UMTS, W-CDMA, CDMA200, WiMAX, WiMAX2 or IEEE802.16.

Note that the small cell is a concept that can include various types of cell that is smaller than the macro cell and is placed to overlap with or not overlap with the macro cell (for example, femtocell, nanocell, picocell, microcell, and the like). In one example, the small cell is operated by a dedicated base station. In another example, the small cell is operated by a terminal serving as a master device temporarily operating as a small cell base station. The so-called relay node can also be regarded as a form of the small cell base station. The wireless communication device functioning as a master station of the relay node is also referred to as a donor base station. The donor base station may mean DeNB in LTE, or may more generally mean a master station of a relay node.

(2) Terminal Device 200

The terminal device 200 can perform communication in a cellular system (or mobile communication system). The terminal device 200 performs wireless communication with a wireless communication device of the cellular system (for example, base station 100A, master device 100B or 100C). For example, the terminal device 200A receives a downlink signal from the base station 100A and transmits an uplink signal to the base station 100A.

Furthermore, the terminal device 200 is not limited to only so-called UE. For example, a so-called low cost terminal (low cost UE) such as an MTC terminal, an enhanced MTC (eMTC) terminal, or an NB-IoT terminal may be applied.

(3) Supplement

The schematic configuration of the system 1 has been described above. However, the present technology is not limited to the example shown in FIG. 1. For example, as the configuration of the system 1, a configuration not including a master device, a small cell enhancement (SCE), a heterogeneous network (HetNet), an MTC network, and the like can be adopted. Furthermore, as another example of the configuration of the system 1, a master device may be connected to a small cell, and a cell may be constructed under the small cell.

One example of the schematic configuration of the system 1 according to one embodiment of the present disclosure has been described above with reference to FIG. 1.

<1.2. Configuration Example of Terminal Device>

Figure 2:
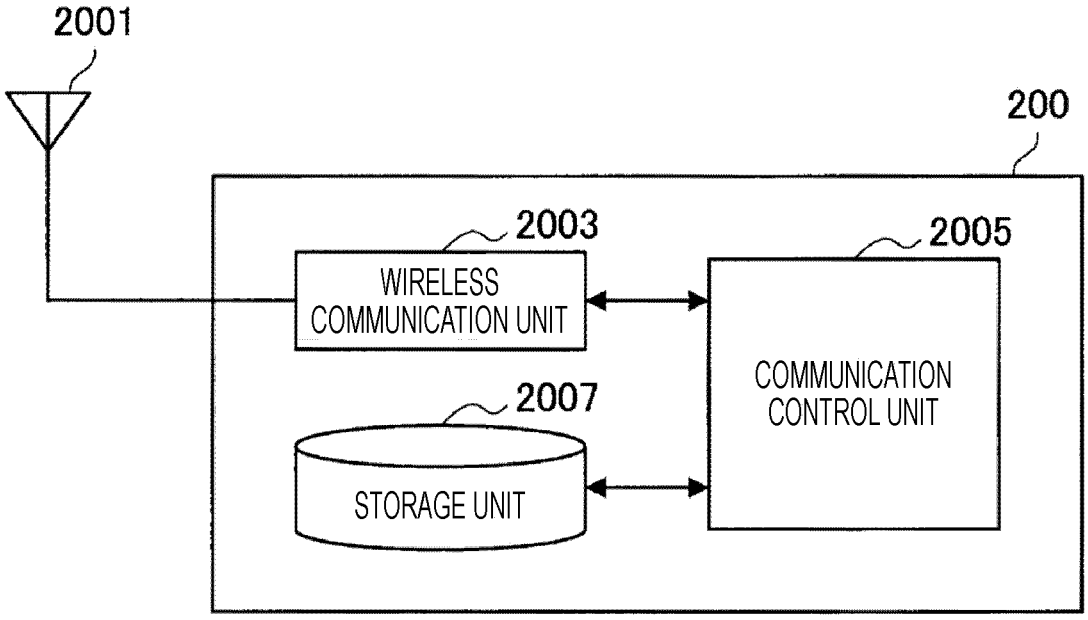
FIG. 2 is a block diagram showing one example of a configuration of a terminal device according to the embodiment.

Next, one example of the configuration of the terminal device 200 according to the embodiment of the present disclosure will be described with reference to FIG. 2. FIG. 2 is a block diagram showing one example of the configuration of the terminal device 200 according to the embodiment of the present disclosure. As shown in FIG. 2, the terminal device 200 includes an antenna part 2001, a wireless communication unit 2003, a storage unit 2007, and a communication control unit 2005.

(1) Antenna Part 2001

The antenna part 2001 radiates a signal output by the wireless communication unit 2003 into space as an electromagnetic wave. Furthermore, the antenna part 2001 converts an electromagnetic wave in space into a signal, and outputs the signal to the wireless communication unit 2003.

(2) Wireless Communication Unit 2003

The wireless communication unit 2003 transmits and receives signals. For example, the wireless communication unit 2003 receives a downlink signal from the base station and transmits an uplink signal to the base station.

(3) Storage Unit 2007

The storage unit 2007 temporarily or permanently stores a program and various data for operating the terminal device 200.

(4), Communication Control Unit 2005

The communication control unit 2005 controls communication with another device (for example, base station 100) by controlling the operation of the wireless communication unit 2003. As one specific example, the communication control unit 2005 may generate a transmission signal by modulating data to be transmitted on the basis of a predetermined modulation method, and cause the wireless communication unit 2003 to transmit the transmission signal to the base station 100. Furthermore, as another example, the communication control unit 2005 may acquire a reception result of a signal from the base station 100 (that is, received signal) from the wireless communication unit 2003, and demodulate the data transmitted from the base station 100 by performing predetermined demodulation processing on the received signal.

One example of the configuration of the terminal device 200 according to the embodiment of the present disclosure has been described above with reference to FIG. 2.

2. OVERVIEW OF COMMUNICATION USING MILLIMETER WAVE

In a communication system based on the standard such as LTE/LTE-A and the like, a wireless signal called an ultrashort wave with a frequency from about 700 MHz to 3.5 GHz is used for communication. In contrast, in the fifth generation (5G) mobile communication system following LTE/LTE-A, the use of communication using a wireless signal called a millimeter wave with a frequency such as 28 GHz or 39 GHz (hereinafter, also simply referred to as "millimeter wave") has been studied. Therefore, after describing the overview of communication using a millimeter wave, a technical problem of the communication device according to one embodiment of the present disclosure will be summarized.

In the communication using an ultrashort wave like LTE/LTE-A, by adopting the technology called so-called multiple-input and multiple-output (MIMO), even under a fading environment, the communication performance can be further improved by using a reflected wave in addition to a direct wave for transmitting and receiving signals.

In contrast, while a millimeter wave can increase an amount of information transmitted more than an ultrashort wave, a millimeter wave has a tendency to have high straightness and increased propagation loss and reflection loss. Therefore, in an environment where no obstacle exists on a path directly connecting antennas that transmit and receive wireless signals (so-called line of site (LOS)), the direct wave mainly contributes to communication characteristics with almost no influence of the reflected wave. From such characteristics, in the communication using a millimeter wave, for example, a communication terminal such as a smartphone and the like receives a wireless signal (that is, millimeter wave) transmitted directly from a base station (that is, receives a direct wave), thereby making it possible to further improve communication performance.

Furthermore, as described above, in the communication using a millimeter wave, the direct wave mainly contributes to communication characteristics, and the influence of the reflected wave is small. From such characteristics, in the communication using a millimeter wave between the communication terminal and the base station, a study has been made into introduction of a technology called polarization MIMO that implements MIMO by using a plurality of polarized waves with polarization directions different from each other (for example, horizontally polarized wave and vertically polarized wave) among wireless signals transmitted as direct waves.

3. CONFIGURATION EXAMPLE OF COMMUNICATION DEVICE ASSUMING USE OF MILLIMETER WAVE

Figure 3:
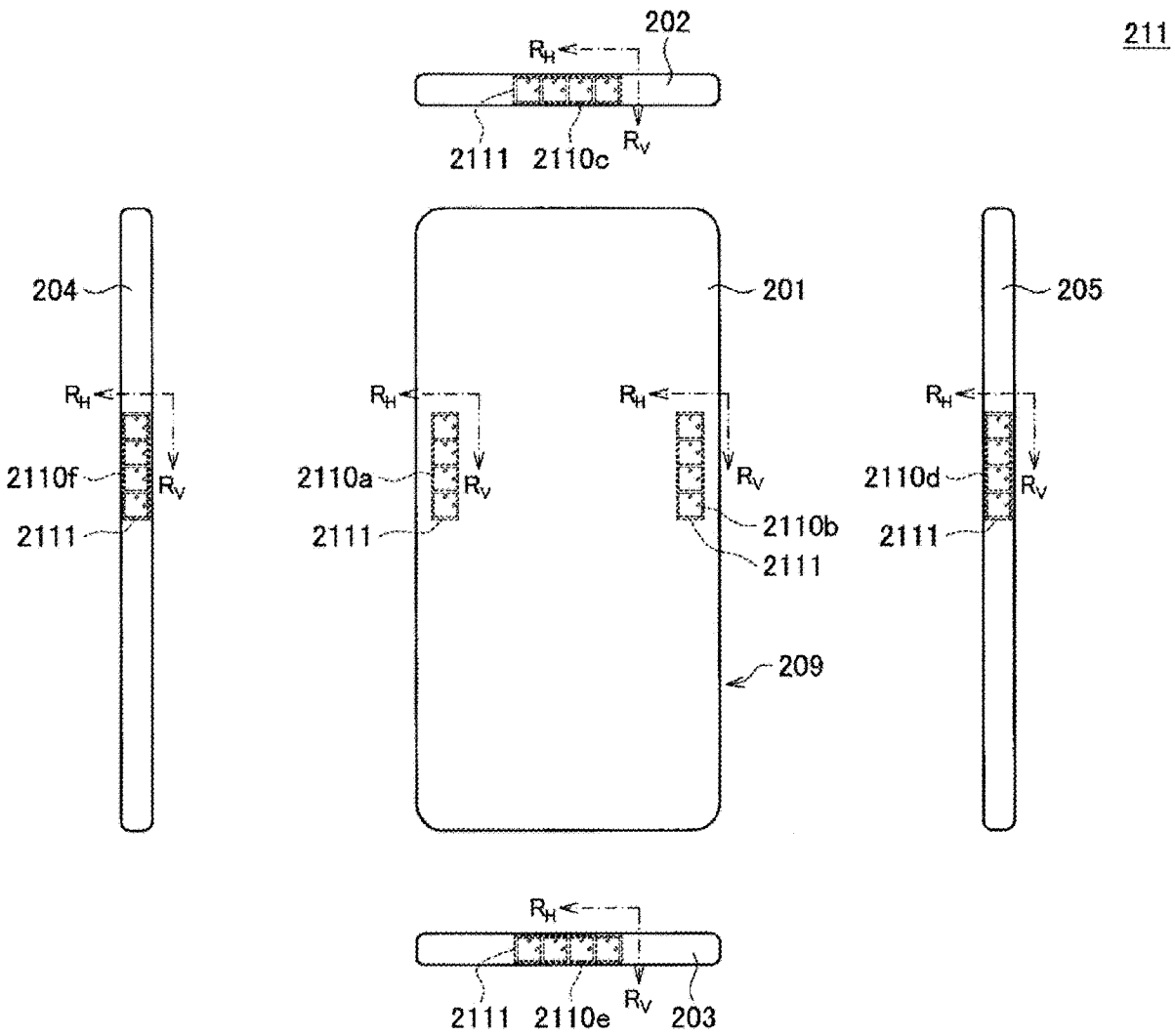
FIG. 3 is an explanatory diagram for describing one example of a configuration of a communication device assuming the use of a millimeter wave.

Subsequently, as a configuration example of a communication device assuming the use of a millimeter wave, one example of a configuration in a case where a so-called patch array antenna in which patch antennas (planar antennas) are arrayed is applied to a communication device such as the terminal device 200 described above will be described. For example, FIG. 3 is an explanatory diagram for describing one example of the configuration of the communication device assuming the use of a millimeter wave. Note that in the following description, the communication device shown in FIG. 3 may be referred to as "communication device 211."

The communication device 211 includes a plate-shaped housing 209 having a front surface and a rear surface having a substantially rectangular shape. Note that in this description, a surface on a side where a display unit such as a display and the like is provided is referred to as a front surface of the housing 209. That is, in FIG. 3, a reference sign 201 indicates the rear surface of an outer surface of the housing 209. Furthermore, reference signs 203 and 205 each correspond to one end surface located around the rear surface 201 out of the outer surfaces of the housing 209. More specifically, the reference signs 203 and 205 each indicate an end surface extending in a longitudinal direction of the rear surface 201. Furthermore, reference signs 202 and 204 each correspond to one end surface located around the rear surface 201 out of the outer surfaces of the housing 209. More specifically, the reference signs 202 and 204 each indicate an end surface extending in a lateral direction of the rear surface 201. Note that illustration is omitted in FIG. 3, a front surface located on an opposite side of the rear surface 201 is also referred to as "front surface 206" for convenience.

Furthermore, in FIG. 3, each of reference signs 2110*a* to 2110*f* indicates an antenna device for transmitting and receiving a wireless signal (for example, millimeter wave) to and from a base station. Note that in the following description, the antenna devices 2110*a* to 2110*f* may be simply referred to as "antenna device 2110" in a case where the antenna devices 2110*a* to 2110*f* are not particularly distinguished.

As shown in FIG. 3, in the communication device 211, the antenna device 2110 is held (installed) inside the housing 209 so as to be located near at least a part of each of the rear surface 201 and the end surfaces 202 to 205.

Furthermore, the antenna device 2110 includes a plurality of antenna elements 2111. More specifically, the antenna device 2110 is configured as an array antenna by arraying the plurality of antenna elements 2111. For example, the antenna elements 2111*a* are provided to be held so as to be located near the end on the end surface 204 side of the rear surface 201 such that the plurality of antenna elements 2111 is arranged along a direction in which the end extends (that is, longitudinal direction of the end surface 204). Furthermore, the antenna elements 2111*d* are provided to be held so as to be located near a part of the end surface 205 such that the plurality of antenna elements 2111 is arranged along a longitudinal direction of the end surface 205.

Furthermore, in the antenna device 2110 held so as to be located near a certain surface, each antenna element 2111 is held such that a normal direction of a flat element substantially agrees with a normal direction of the surface. As more specific one example, in a case where attention is paid to the antenna device 2110*a*, the antenna element 2111 provided in the antenna device 2110*a* is held such that the normal direction of the flat element substantially agrees with the normal direction of the rear surface 201. This is similar for the other antenna devices 2110*b* to 2110*f*.

With the above-described configuration, each antenna device 2110 controls the phase and power of a wireless signal transmitted or received by each of the plurality of antenna elements 2111, thereby making it possible to control directivity of the wireless signal (that is, perform beam forming).

Figure 4:
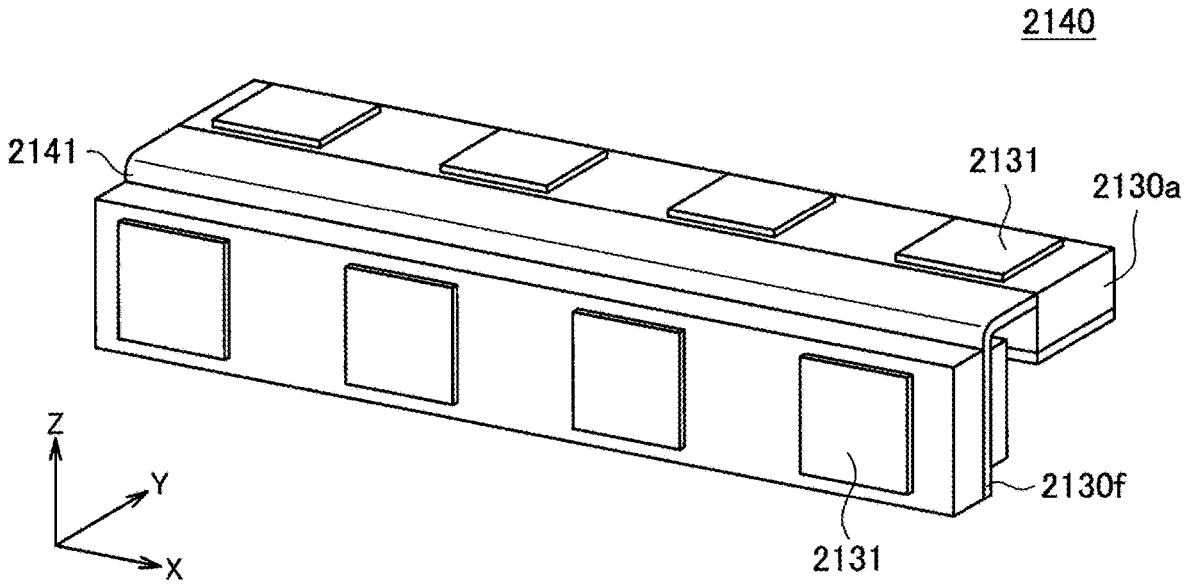
FIG. 4 is an explanatory diagram for describing one example of a schematic configuration of an antenna device applied to the communication device assuming the use of a millimeter wave.

Subsequently, with reference to FIG. 4, one example of the schematic configuration of the antenna device applied to the communication device 211 assuming the use of a millimeter wave will be described. FIG. 4 is an explanatory diagram for describing one example of the schematic configuration of the antenna device applied to the communication device 211 assuming the use of a millimeter wave.

The antenna device 2140 shown in FIG. 4 has a configuration in which two antenna devices 2130 different from each other are connected by a connection part 2141. Note that in the example shown in FIG. 4, the antenna devices 2130*a* and 2130*f* correspond to, for example, the antenna devices 2110*a* and 2110*f* in the example shown in FIG. 3, respectively. That is, the antenna elements shown by a reference sign 2131 in FIG. 4 correspond to the antenna elements 2111 shown in FIG. 3. Note that in the example shown in FIG. 4, for convenience, a direction in which the plurality of antenna elements 2131 is arranged may be referred to as an x direction, and a thickness direction of the antenna device 2140 may be referred to as a z direction. Furthermore, a direction orthogonal to both the x direction and the z direction may be referred to as a y direction.

As shown in FIG. 4, the antenna devices 2130*a* and 2130*f* are placed such that, out of ends of the antenna devices 2130*a* and 2130*f*, one of the ends extending in the direction in which the plurality of antenna elements 2131 is arranged is located near each other. At this time, the antenna element 2131 of the antenna device 2130*a* and the antenna element 2131 of the antenna device 2130*f* are placed such that the normal directions of the flat elements intersect each other (for example, orthogonal), or the normal directions are at positions twisted around each other. Furthermore, the connection part 2141 is provided to be constructed between ends of the antenna device 2130*a* and the antenna device 2130*f* located near each other. The antenna device 2130*a* and the antenna device 2130*f* are connected by the connection part 2141.

The antenna device 2140 having the above-described configuration is preferably held along a plurality of surfaces (outer surfaces) connected to each other out of the outer surfaces of the housing 209, for example, like the rear surface 201 and the end surface 204 shown in FIG. 3. With such a configuration, a wireless signal arriving from a direction substantially perpendicular to each of the plurality of surfaces connected to each other can be transmitted or received in a more preferred mode.

One example of the schematic configuration of the antenna device applied to the communication device 211 assuming the use of a millimeter wave has been described above with reference to FIG. 4.

4. TECHNICAL PROBLEM

Figure 5:
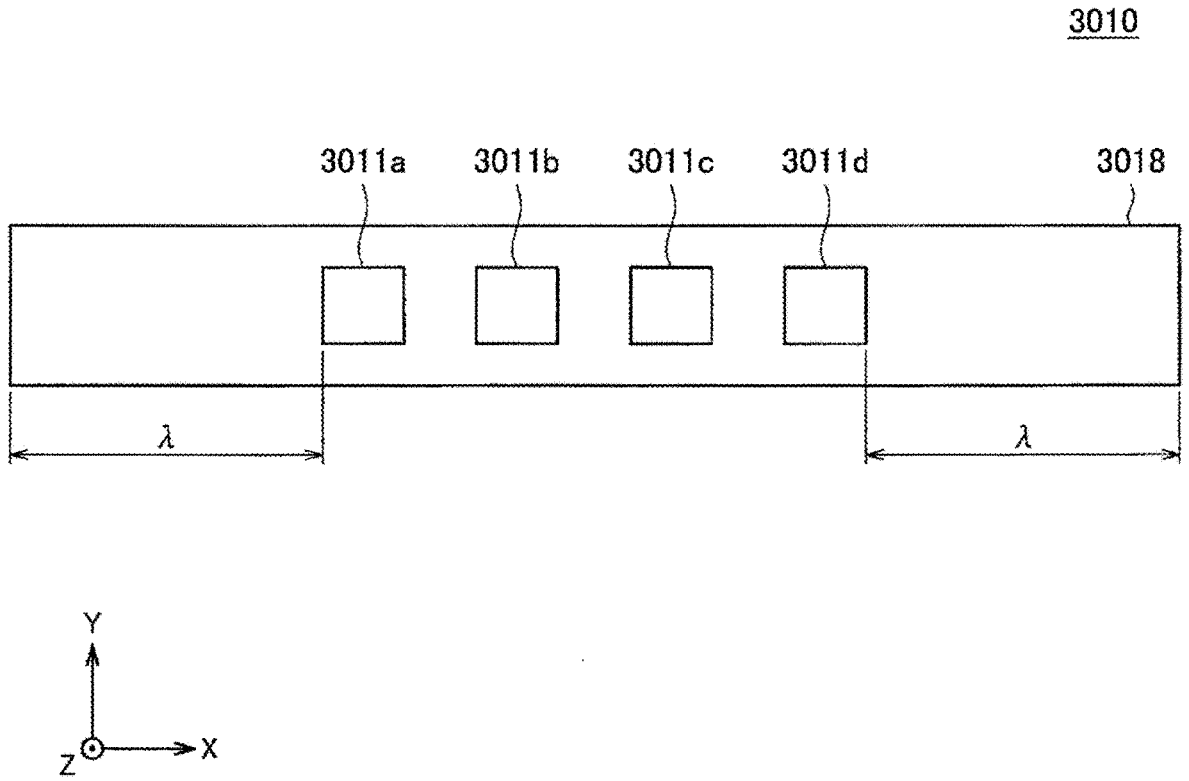
FIG. 5 is an explanatory diagram for describing a technical problem of the antenna device applied to the communication device assuming the use of a millimeter wave.

Subsequently, with reference to FIG. 5, the technical problem of the antenna device applied to the communication device 211 assuming the use of a millimeter wave will be described. FIG. 5 is an explanatory diagram for describing the technical problem of the antenna device applied to the communication device 211 assuming the use of a millimeter wave. An antenna device 3010 shown in FIG. 5 corresponds to one example of the configuration of the antenna device 2110 in the communication device 211 described with reference to FIG. 3. That is, the example shown in FIG. 5 shows one example of the configuration of the patch array antenna in which patch antennas are arrayed.

As shown in FIG. 5, the antenna device 3010 includes antenna elements 3011*a* to 3011*d* and a dielectric substrate 3018. In the antenna device 3010 shown in FIG. 5, each of the antenna elements 3011*a* to 3011*d* is configured as a patch antenna (planar antenna). Note that in the example shown in FIG. 5, for convenience, the normal direction of the flat element constituting each of the plurality of antenna elements 3011*a* to 3011*d* is defined as a z direction. Furthermore, the direction in which the plurality of antenna elements 3011*a* to 3011*d* is arranged may be referred to as an x direction, in particular, the right direction of the drawing may be referred to as "+x direction", and the left direction of the drawing may be referred to as "−x direction."

Furthermore, a direction orthogonal to both the x direction and the z direction is defined as a y direction. That is, in the example shown in FIG. 5, the antenna elements 3011*a* to 3011*d* are disposed on a surface of the dielectric substrate 3018 so as to be spaced apart from each other in this order along the x direction. Furthermore, in the following, the antenna elements 3011*a* to 3011*d* may be referred to as "antenna element 3011" unless particularly distinguished. Furthermore, in the following description, like the antenna elements 3011*a* to 3011*d*, the direction in which a plurality of antenna elements constituting an array antenna is arranged may be simply referred to as "arrangement direction." For example, in the example shown in FIG. 5, the arrangement direction of the plurality of antenna elements 3011 is the x direction.

As shown in FIG. 5, in the antenna device in which a plurality of antenna elements constitutes a so-called array antenna, a distortion may occur in a radiation pattern of some antenna elements. As one specific example, in the example shown in FIG. 5, in each of the antenna elements 3011*a* to 3011*d* arranged along the x direction, a distortion of the radiation pattern may occur in the arrangement direction (x direction) because a current is pulled by another antenna element 3011 disposed adjacent to each other (that is, another antenna element 3011 located nearby).

As one more specific example, the antenna element 3011*b* is disposed so as to be mutually adjacent to the other antenna elements 3011*a* and 3011*c* in both the arrangement directions. Therefore, a distortion of the radiation pattern occurs in both the arrangement directions (that is, +x direction and −x direction). Note that in this case, symmetry of the arrangement direction of the radiation pattern of the antenna element 3011*b* is maintained. This is similar for the antenna element 3011*c*.

Meanwhile, for the antenna elements 3011*a* and 3011*d* located at the ends in the arrangement direction (x direction), the other antenna elements 3011 are disposed only in one of the arrangement directions. Therefore, for example, in the antenna element 3011*a*, since a current is pulled by the antenna element 3011*b* disposed adjacent to each other, a distortion of the radiation pattern may occur in the direction in which the antenna element 3011*b* is located, and symmetry of the radiation pattern along the arrangement direction may be impaired. Similarly, in the antenna element 3011*d*, because of an influence of the antenna element 3011*c* disposed adjacent to each other, a distortion of the radiation pattern may occur in the direction in which the antenna element 3011*c* is located, and symmetry of the radiation pattern along the arrangement direction may be impaired.

As described above, for the antenna element 3011 located on the end side in the arrangement direction, as a method for securing symmetry of the radiation pattern in the arrangement direction, for example, as shown in FIG. 5, a method for providing a sufficiently large ground area around the antenna element 3011 can be cited. As one specific example, for the antenna element 3011*a*, on the −x direction side where no other antenna element 3011 is disposed in the arrangement direction, a ground area having a length equal to or longer than a wavelength λ of the wireless signal transmitted or received by the antenna element 3011*a* is provided. That is, in this case, for example, the dielectric substrate 3018 is further extended from the position where the antenna element 3011*a* is disposed in the −x direction by the length of the wavelength λ or more. Similarly, for the antenna element 3011*d*, on the +x direction side where no other antenna element 3011 is disposed in the arrangement direction, a ground area having a length equal to or longer than the wavelength λ of the wireless signal transmitted or received by the antenna element 3011*d* is provided. That is, in this case, for example, the dielectric substrate 3018 is further extended from the position where the antenna element 3011*d* is disposed in the +x direction by the length of the wavelength λ or more.

However, in a case where the ground area as shown in FIG. 5 is provided to secure symmetry of the radiation pattern of the antenna element 3011 located on the end side in the arrangement direction (for example, antenna elements 3011*a* and 3011*d*), the size of the antenna device (particularly, the size in the arrangement direction described above) becomes larger due to characteristics thereof.

In light of such a situation, the present disclosure proposes a technology that enables miniaturization of the antenna device to be achieved in a more preferred mode in a case where the plurality of antenna elements is arrayed. Specifically, the present disclosure proposes a technology that enables both securing symmetry of the radiation pattern of each antenna element (particularly, antenna element located on the end side in the arrangement direction) and miniaturizing the antenna device in a more preferred mode in a case where the plurality of antenna elements is arrayed.

5. TECHNICAL ADVANTAGE

The following describes technical features of the antenna device according to one embodiment of the present disclosure.

<5.1. Configuration>

Figure 6:
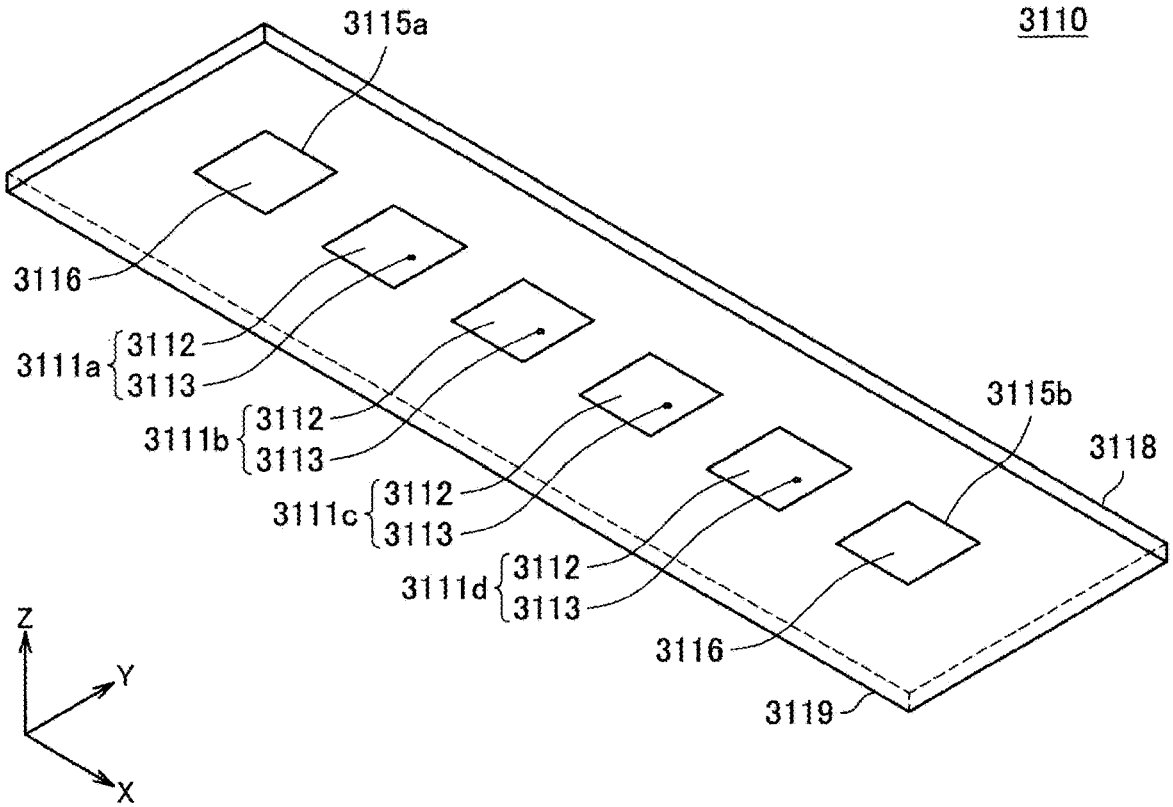
FIG. 6 is an explanatory diagram for describing one example of the schematic configuration of the antenna device according to the embodiment.

To begin with, one example of the configuration of the antenna device according to one embodiment of the present disclosure will be described. For example, FIG. 6 is an explanatory diagram for describing one example of the schematic configuration of the antenna device according to the present embodiment, and shows one example of the configuration of the patch array antenna in which patch antennas are arrayed. Note that in the following description, the antenna device shown in FIG. 6 may be referred to as "antenna device 3110" in order to distinguish the antenna device from other antenna devices.

As shown in FIG. 6, in the antenna device 3110, antenna elements 3111*a* to 3111*d* are disposed to be spaced apart from each other in this order along a predetermined direction on one surface of a dielectric substrate 3118. Each of the antenna elements 3111*a* to 3111*d* includes a flat element 3112 and a feeding point 3113. Note that in the following description, the antenna elements 3111*a* to 3111*d* may be referred to as "antenna element 3111" unless particularly distinguished. Furthermore, in the following description, the normal direction of the flat element 3112 constituting the antenna element 3111 is a z direction, in particular, the front surface (upper surface) side of the element 3112 may be referred to as "+z direction", and the rear surface (lower surface) side may be referred to as "−z direction." Furthermore, the arrangement direction of the antenna elements 3111*a* to 3111*d* is referred to as a −x direction, in particular the antenna element 3111*a* side is referred to as "−x direction", and the antenna element 3111*d* side is referred to as "+x direction."

Furthermore, a direction orthogonal to both the x direction and the z direction is defined as a y direction.

On the other surface of the dielectric substrate 3118 (that is, surface on the −z direction side), a substantially flat ground plate 3119 is provided so as to cover substantially the entire surface. The feeding point 3113 of each of the antenna elements 3111*a* to 3111*d* is provided to penetrate the dielectric substrate 3118 along the normal direction (z direction) of the corresponding element 3112 and electrically connects the element 3112 to the ground plate 3119 described above.

Furthermore, on one surface of the dielectric substrate 3118 (that is, surface on the +z direction side), out of the antenna elements 3111*a* to 3111*d* arranged in the x direction, a parasitic element 3115 is disposed so as to be mutually adjacent in the arrangement direction to the antenna element 3111 located on the end side in the arrangement direction (that is, x direction). More specifically, the parasitic element 3115*a* is disposed so as to be mutually spaced apart from the antenna element 3111*a* in the arrangement direction described above (x direction) on the opposite side of the antenna element 3111*b* (that is, −x direction) with respect to the antenna element 3111*a*. Similarly, the parasitic element 3115*b* is disposed so as to be mutually spaced apart from the antenna element 3111*d* in the arrangement direction described above (x direction) on the opposite side of the antenna element 3111*c* (that is, +x direction) with respect to the antenna element 3111*d*.

The parasitic element 3115 includes a flat element 3116. The element 3116 may be formed so as to have substantially the same shape as the element 3112 of the antenna element 3111. Furthermore, the element 3116 may be formed to have substantially the same size as the element 3112. Meanwhile, the parasitic element 3115 is different from the antenna element 3111 in that the parasitic element 3115 does not have a feeding point for transmitting or receiving a wireless signal via the element 3116.

Furthermore, the element 3116 of the parasitic element 3115 may be used as a pad for another sensor to detect various states. Therefore, various circuits for causing the element 3116 to function as the pad for the sensor described above may be electrically connected to the element 3116 of the parasitic element 3115. Note that examples of the sensor described above include a proximity sensor for detecting proximity of an object (for example, capacitive sensor), and the like.

Figure 7:
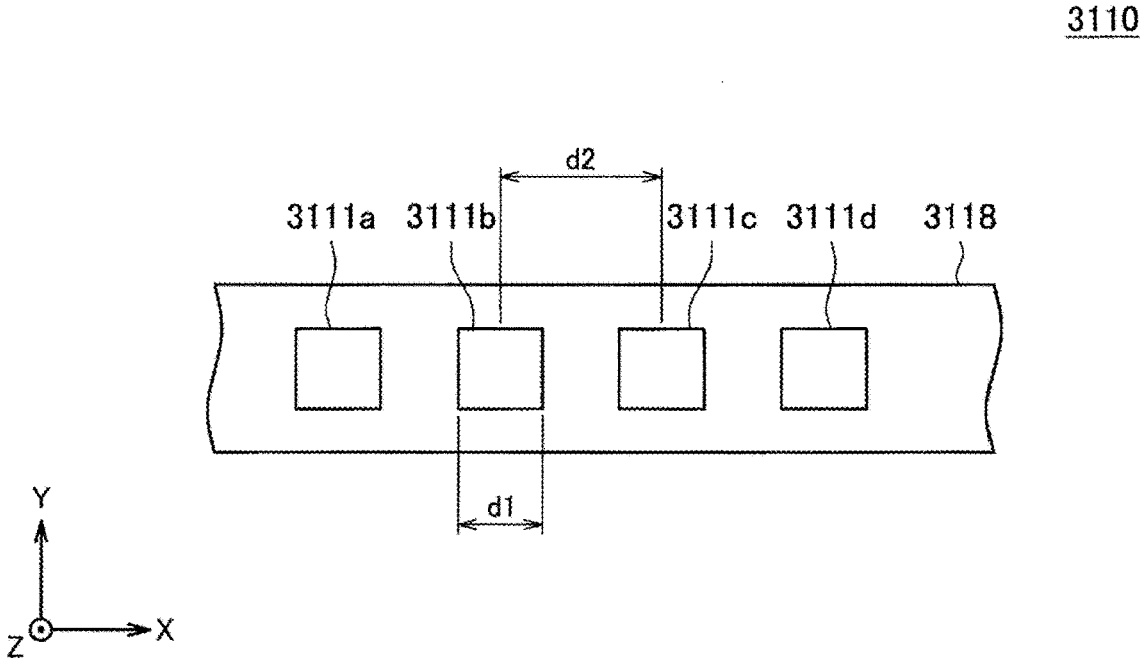
FIG. 7 is an explanatory diagram for describing one example of the configuration of the antenna device according to the embodiment.

Subsequently, with reference to FIG. 7, out of the antenna device 3110 according to the present embodiment, a more detailed configuration of a portion in which the plurality of antenna elements 3111 constitutes the array antenna will be described with attention particularly paid to the size of each part. FIG. 7 is an explanatory diagram for describing one example of the configuration of the antenna device 3110 according to the present embodiment, and shows one example of the schematic configuration of the antenna device 3110 in a case where the antenna device 3110 is viewed from vertically above (+z direction). Note that the x direction, y direction, and z direction in FIG. 7 correspond to the x direction, y direction, and z direction in FIG. 6, respectively.

In FIG. 7, a reference sign d1 indicates a width of each of the plurality of antenna elements 3111 in the arrangement direction (x direction) (that is, size of the antenna element 3111). Here, when a relative permittivity of a resin frame constituting the antenna device 3110 (that is, dielectric substrate 3118) is εr and a wavelength of a wireless signal transmitted or received by the antenna device 3110 is λ, a width calculated on the basis of a relational expression shown below as (Equation 1) is a guideline for the width d1.

[Equation 1]

$$d1 = \frac{\lambda}{2\sqrt{\varepsilon r}} \quad \text{(EQUATION 1)}$$

Since the relative permittivity of the resin generally used for the resin frame described above is about 4, in a case where the relative permittivity εr=4, the width d1 is calculated on the basis of the relational expression shown below as (Equation 2).

[Equation 2]

$$d1 = \frac{\lambda}{4} \quad \text{(EQUATION 2)}$$

Of course, it is also possible to use a resin having a higher dielectric constant as the resin used for the resin frame described above. In this case, as shown in (Equation 1) described above, the width d1 can be made shorter, that is, an element having a smaller size can be applied as the antenna element 3111. Note that the width d1 of the antenna elements 3111 in the arrangement direction corresponds to one example of a "second width."

Furthermore, a reference sign d2 indicates an element interval between two antenna elements 3111 adjacent to each other among the plurality of antenna elements 3111 constituting the array antenna. Note that in the present disclosure, the "element interval" indicates an interval between centers of the two antenna elements 3111 adjacent to each other.

From the viewpoint of further reducing a distortion of the radiation pattern, as the element interval d2, the two antenna elements 3111 adjacent to each other are preferably disposed so as to be spaced apart as far as possible.

Meanwhile, when d2≥λ, an operation as an array antenna may cause unwanted emission called grating lobes and lower the gain in a predetermined direction. In contrast, in the range of λ/2<d2<λ, the element interval d2 at which the grating lobes occur depends on the required beam scanning angle.

In view of the above conditions, each antenna element 3111 is preferably disposed such that the element interval d2 satisfies the condition shown below as (Equation 3).

[Equation 3]

$$\frac{\lambda}{2} \leq d < \lambda \qquad \text{(EQUATION 3)}$$

Therefore, as the element interval d2, for example, an interval calculated on the basis of a relational expression shown below as (Expression 4) may be used as a guideline. Note that the element interval d2 between the two antenna elements 3111 adjacent to each other in the arrangement direction corresponds to one example of a "second element interval."

[Equation 4]

$$d2 = \frac{\lambda}{2} \qquad \text{(EQUATION 4)}$$

Figure 8:
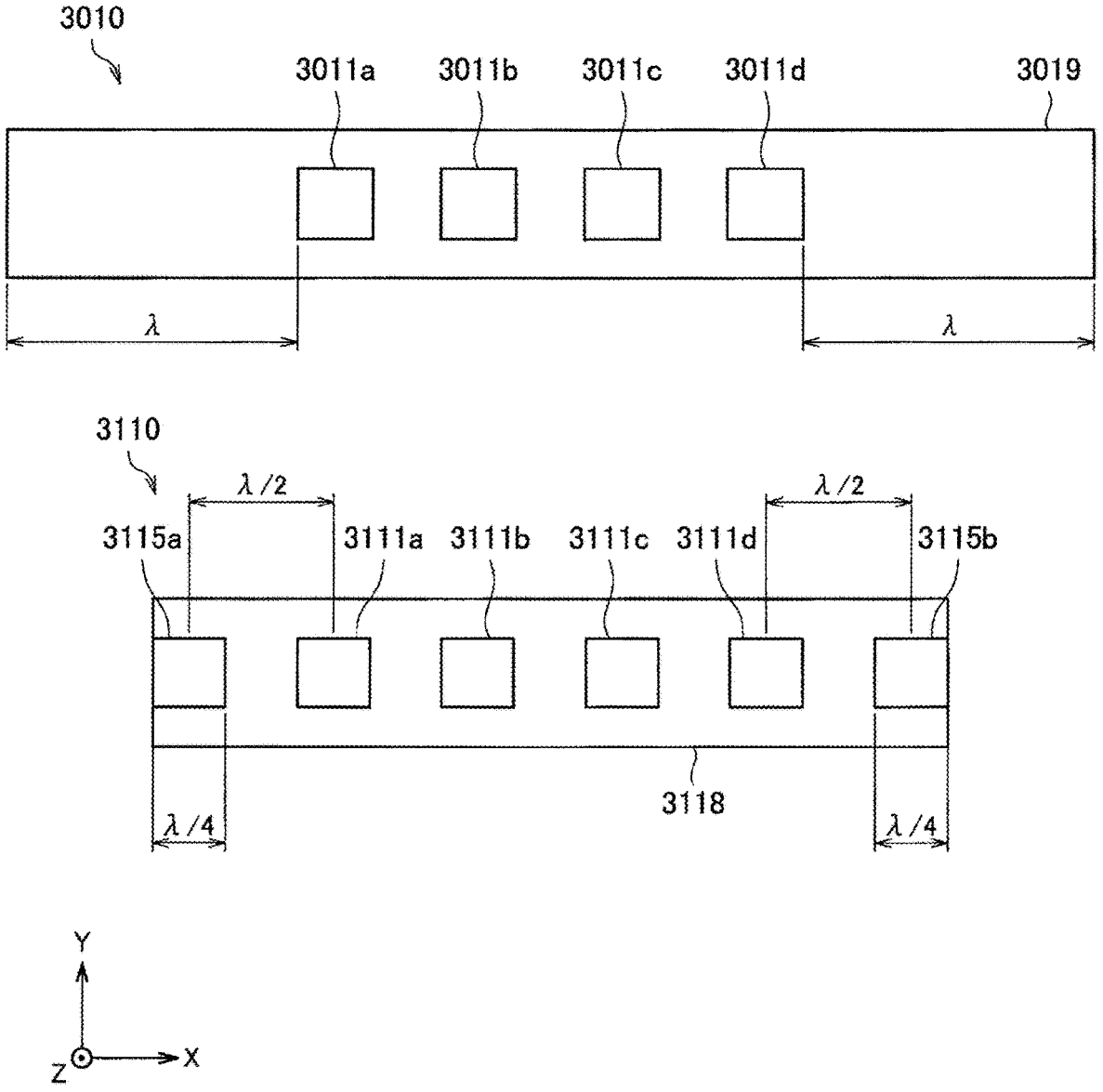
FIG. 8 is an explanatory diagram for describing one example of the configuration of the antenna device according to the embodiment.

Subsequently, with reference to FIG. 8, after describing in detail the size and installation position of the parasitic elements 3115, the features of the antenna device 3110 according to the present embodiment will be described with attention paid to the size of the antenna device 3110. FIG. 8 is an explanatory diagram for describing one example of the configuration of the antenna device 3110 according to the present embodiment, and shows one example of the schematic configuration of the antenna device 3110 in a case where the antenna device 3110 is viewed from vertically above (+z direction). Note that the x direction, y direction, and z direction in FIG. 8 correspond to the x direction, y direction, and z direction in FIG. 6, respectively.

For example, the parasitic element 3115 may be formed to be substantially identical to the antenna element 3111 in size. That is, in a case where the width of the parasitic element 3115 in the x direction (that is, width of each of the plurality of antenna elements 3111 in the arrangement direction) is d3, the parasitic element 3115 is preferably formed such that the width d3 is substantially equal to the width d2 indicated by (Formula 1) or (Formula 2) described above. Furthermore, the parasitic element 3115 is preferably formed so as to have substantially the same shape as the antenna element 3111. Note that the width d3 of the parasitic element 3115 in the arrangement direction described above corresponds to one example of the "first width."

Furthermore, d4 is the element interval between the parasitic element 3115 and the antenna element 3111 mutually adjacent to the parasitic element 3115 (that is, antenna element 3111 located on the end side in the arrangement direction). The parasitic element 3115 is preferably disposed such that the element interval d4 is equal to or less than the wavelength λ of the wireless signal transmitted or received by the antenna element 3111 described above. In other words, in view of (Equation 4) described above, the parasitic element 3115 is preferably disposed such that the element interval d4 is equal to or less than twice the element interval d2 (d4≤2×d2). Note that the element interval d4 between the parasitic element 3115 and the antenna element 3111 mutually adjacent to the parasitic element 3115 corresponds to one example of the "first element interval."

For example, the example shown in FIG. 8 shows one example of the configuration of the antenna device 3110 in a case where the width d3=d1=λ/4 and the element interval d4=d2=λ/2. Note that in the example shown in FIG. 8, with respect to the antenna element 3111 that is mutually adjacent (that is, antenna element 3111 located at the end in the arrangement direction), the parasitic element 3115 is disposed at a position symmetrical to another antenna element 3111 mutually adjacent to the antenna element 3111. More specifically, the parasitic element 3115*a* is disposed at a position symmetrical to the antenna element 3111*b* with respect to the antenna element 3111*a*. Similarly, the parasitic element 3115*b* is disposed at a position symmetrical to the antenna element 3111*c* with respect to the antenna element 3111*d*. Note that the antenna element 3111 located at the end in the arrangement direction (for example, antenna elements 3111*a* and 3111*d* shown in FIG. 8) corresponds to one example of the "first antenna element." Furthermore, another antenna element 3111 mutually adjacent to the first antenna element (for example, antenna elements 3111*b* and 3111*c* shown in FIG. 8) corresponds to one example of the "second antenna element."

Furthermore, the example shown in FIG. 8 also shows the antenna device 3010 described with reference to FIG. 5 as a comparison target. As shown in FIG. 8, since the parasitic elements 3115 (that is, parasitic elements 3115*a* and 3115*b*) are provided, the antenna device 3110 according to the present embodiment does not need to extend the dielectric substrate 3118 from the parasitic elements 3115 toward the outside of the plurality of antenna elements 3111 in the arrangement direction (x direction). Therefore, it is possible to miniaturize the size of the antenna device 3110 in the arrangement direction described above more than the antenna device 3010.

Note that in the antenna device 3110 described with reference to FIGS. 6 and 8, the parasitic element 3115 (that is, parasitic elements 3115*a* and 3115*b*) is provided so as to be mutually adjacent, in the arrangement direction, to each of the antenna elements 3111*a* and 3111*d* located on the end side in the arrangement direction. Meanwhile, the parasitic element 3115 may be provided so as to be mutually adjacent, in the arrangement direction of the antenna element 3111, to only either antenna element 3111 out of the antenna elements 3111*a* and 3111*d* located on the end side in the arrangement direction.

Figure 9:
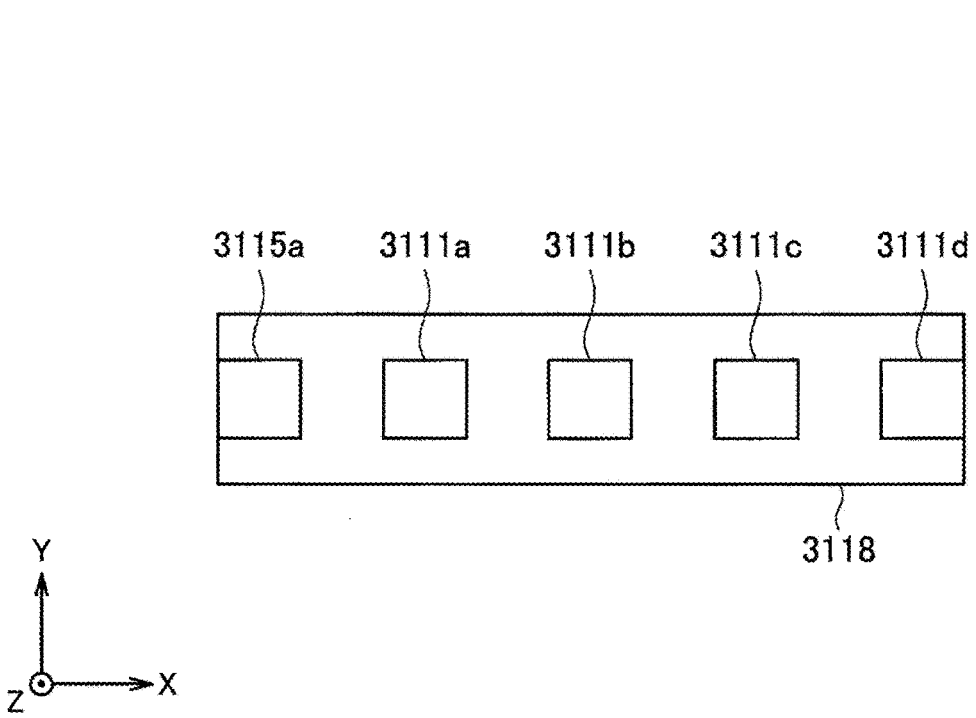
FIG. 9 is an explanatory diagram for describing another example of the configuration of the antenna device according to the embodiment.
Figure 10:
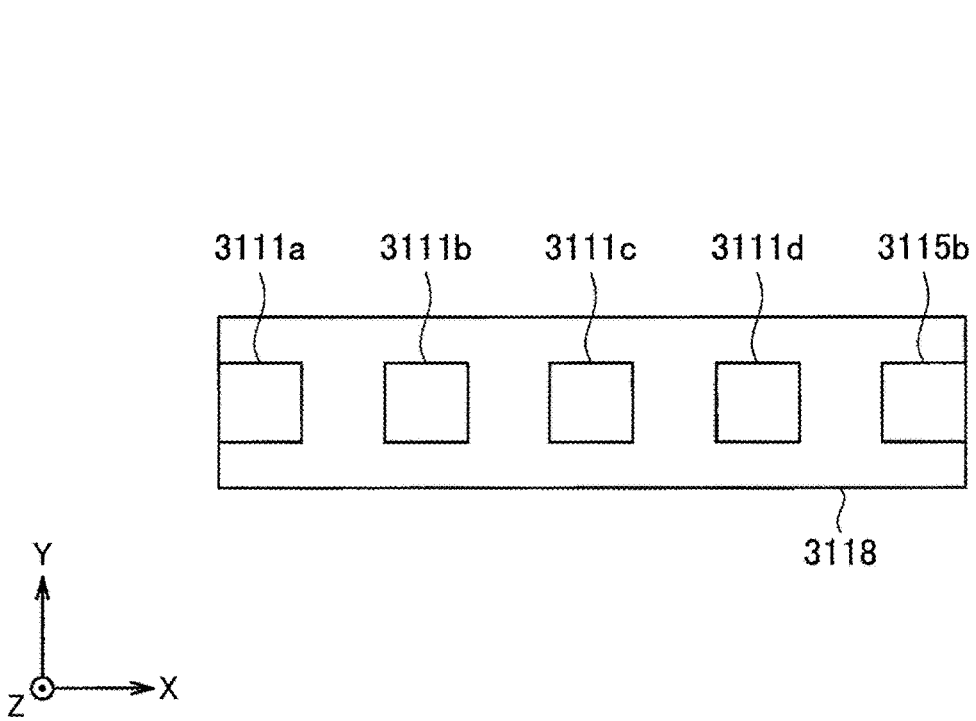
FIG. 10 is an explanatory diagram for describing another example of the configuration of the antenna device according to the embodiment.

For example, FIGS. 9 and 10 are each an explanatory diagram for describing another example of the configuration of the antenna device according to the present embodiment. Specifically, FIG. 9 shows one example of the configuration in a case where the parasitic element 3115*a* is provided so as to be mutually adjacent, out of the antenna elements 3111*a* and 3111*d* described above, to only the antenna element 3111*a* in the arrangement direction. Furthermore, FIG. 10 shows one example of the configuration in a case where the parasitic element 3115*b* is provided so as to be mutually adjacent, out of the antenna elements 3111*a* and 3111*d* described above, to only the antenna element 3111*d* in the arrangement direction. Note that in the following description, the antenna device shown in FIG. 9 may be referred to as "antenna device 3130" in order to distinguish the antenna device from other antenna devices. Furthermore, the antenna device shown in FIG. 10 may be referred to as "antenna device 3150" in order to distinguish the antenna device from other antenna devices. Furthermore, the antenna device shown in each of FIGS. 6, 9, and 10 may be simply referred to as "antenna device 3110" unless particularly distinguished. That is, in the following description, simple description of "antenna device 3110" can include the antenna devices 3130 and 3150 as long as there is no inhibiting factor caused by a difference in a method for disposing the parasitic element 3115.

One example of the configuration of the antenna device according to one embodiment of the present disclosure has been described above with reference to FIGS. 6 to 10.

<5.2. Characteristics of Antenna Device>

Subsequently, a simulation result of characteristics of the antenna device according to the present embodiment will be described.

(Simulation Result of Radiation Pattern)

Figure 11:
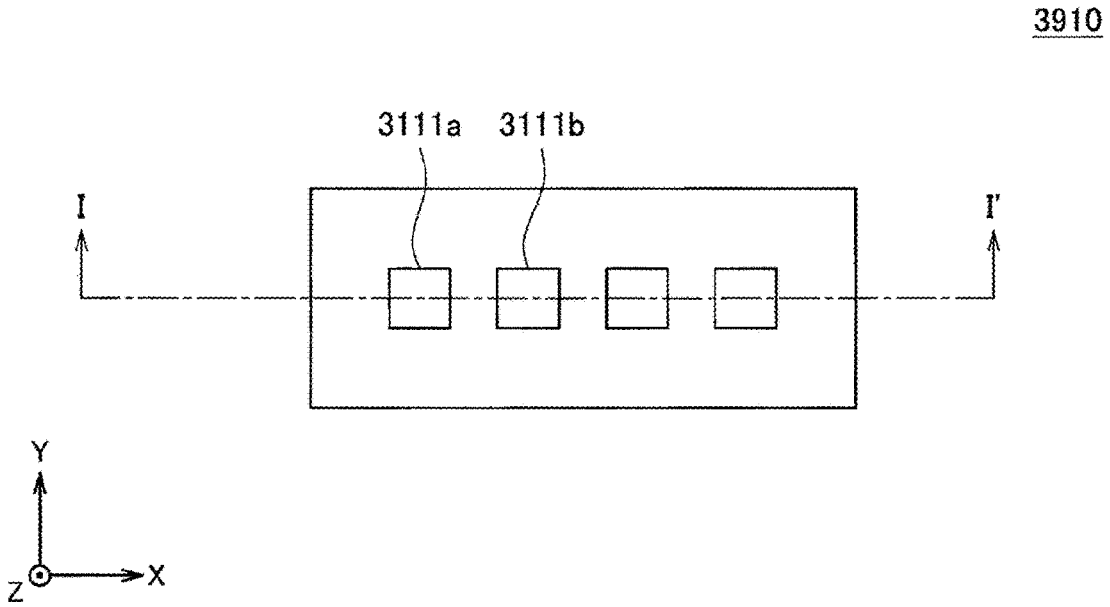
FIG. 11 is a diagram showing one example of a schematic configuration of an antenna device according to a comparative example.

To begin with, as the characteristics of the antenna device according to the present embodiment, one example of the simulation result of the radiation pattern of each antenna element constituting the antenna device will be described. Note that in order to make the characteristics of the antenna device 3110 according to the present embodiment easier to understand, to begin with, as a comparative example, one example of the radiation pattern of the antenna element in a case where the configuration corresponding to the parasitic element 3115 in the antenna device 3110 is not provided will be described. For example, FIG. 11 is a diagram showing one example of the schematic configuration of the antenna device according to the comparative example, and shows one example of the schematic configuration of the antenna device in a case where the antenna device is viewed from vertically above (+z direction). Note that the x direction, y direction, and z direction in FIG. 11 correspond to the x direction, y direction, and z direction in FIG. 6, respectively. Furthermore, in the following description, the antenna device shown in FIG. 11 is also referred to as "antenna device 3910" for convenience.

As shown in FIG. 11, in the antenna device 3910 according to the comparative example, in a similar manner to the antenna device 3110 according to the present embodiment described above, a plurality of antenna elements 3111 is disposed to be spaced apart from each other along the x direction, and the plurality of antenna elements 3111 constitutes an array antenna. Meanwhile, in the antenna device 3910, a configuration corresponding to the parasitic element 3115 is not disposed as in the antenna device 3110, and does not have a configuration to extend the dielectric substrate in the arrangement direction (x direction) as in the antenna device 3010 described above with reference to FIG. 5. Under such a configuration, a simulation of the radiation pattern has been performed, out of the plurality of antenna elements 3111, on each of the antenna element 3111*a* located on the end side in the −x direction and the antenna element 3111*b* mutually adjacent to the antenna element 3111*a* in the +x direction.

Figure 12:
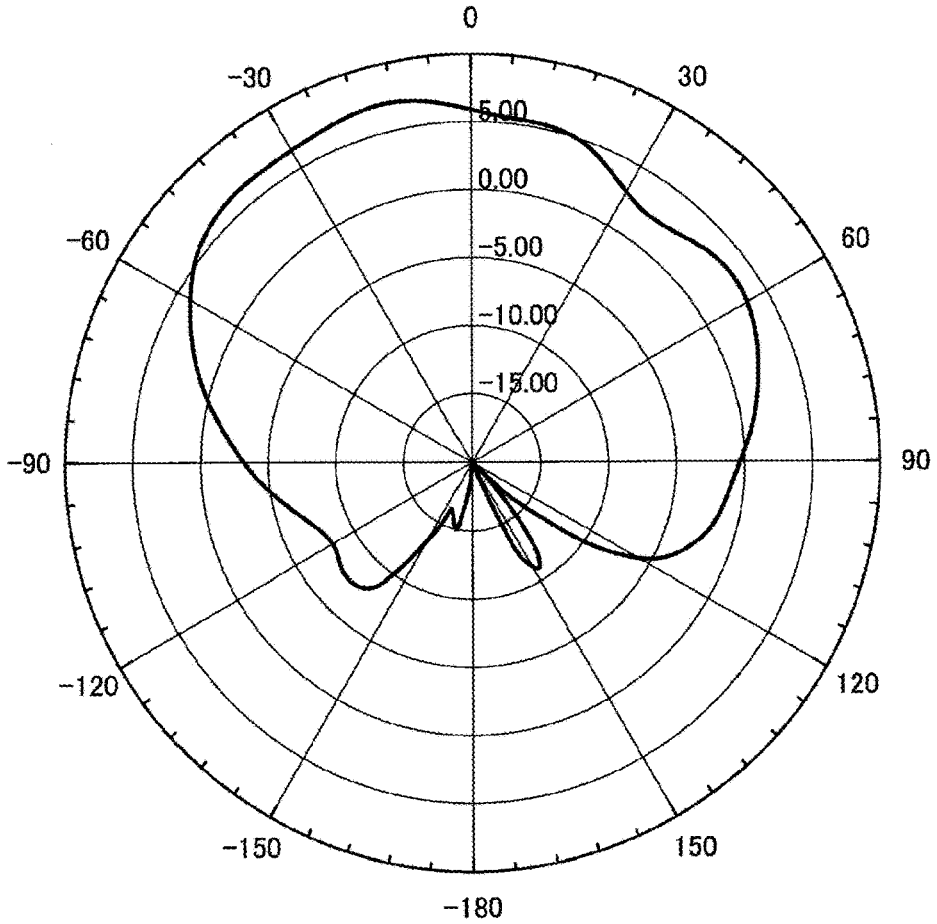
FIG. 12 is a diagram showing one example of a simulation result of a radiation pattern of an antenna element in the antenna device according to the comparative example.
Figure 13:
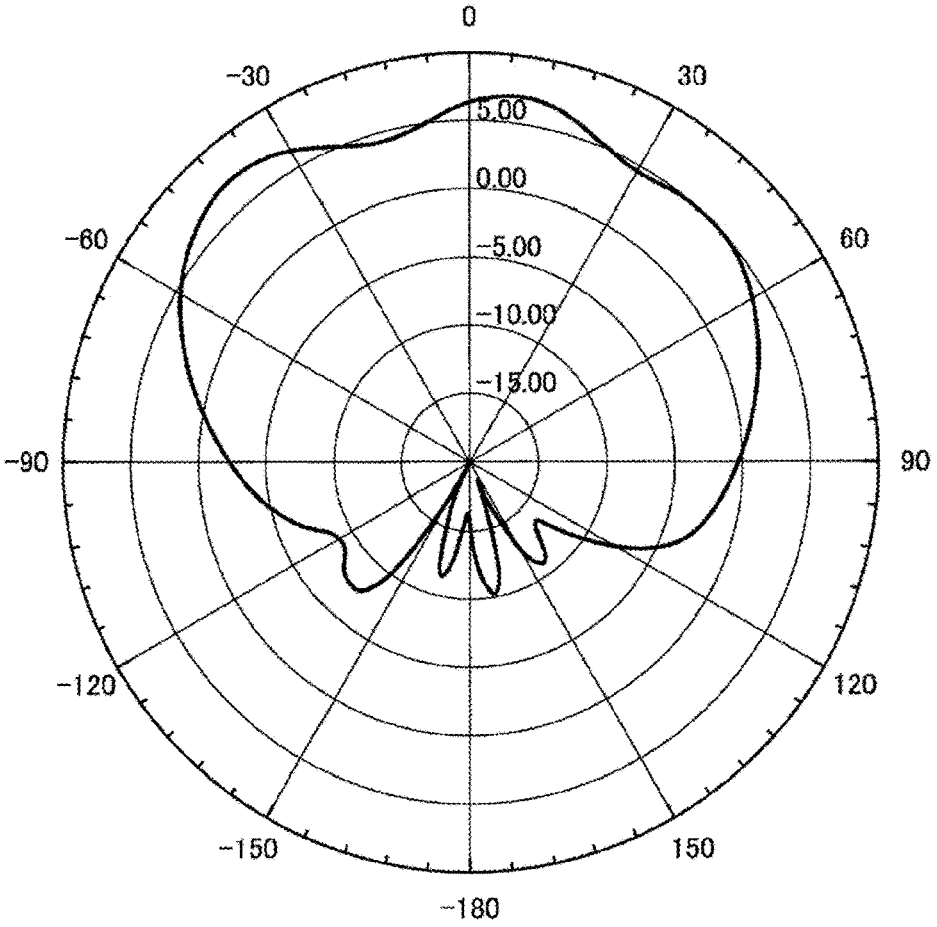
FIG. 13 is a diagram showing one example of the simulation result of the radiation pattern of the antenna element in the antenna device according to the comparative example.

For example, FIGS. 12 and 13 are each a diagram showing one example of a simulation result of the radiation pattern of the antenna element in the antenna device 3910 according to the comparative example.

Specifically, FIG. 12 shows one example of the radiation pattern of the antenna element 3111*a* in a case where the radiation pattern is cut along the I-I' plane (xz plane) of FIG. 11. FIG. 12 shows that a distortion occurs in the radiation pattern of the antenna element 3111*a* on the +x direction side. It is presumed that the distortion is caused by the influence of the antenna element 3111*b* mutually adjacent to the antenna element 3111*a*. In contrast, no distortion occurs in the radiation pattern of the antenna element 3111*a* on the −x direction side. That is, as shown in FIG. 12, in the antenna device 3910 according to the comparative example, the shape of the radiation pattern of the antenna element 3111*a* is asymmetric in the x direction.

Furthermore, FIG. 13 shows one example of the radiation pattern of the antenna element 3111*b* in a case where the radiation pattern is cut along the I-I' plane (xz plane) of FIG. 11. Other antenna elements 3111 are disposed mutually adjacent to the antenna element 3111*b* in both the +x direction and the −x direction. Therefore, as shown in FIG. 13, a distortion occurs in the radiation pattern of the antenna element 3111*b* in both the +x direction and the −x direction. With this arrangement, as a result, the shape of the radiation pattern of the antenna element 3111*b* is targeted in the x direction.

Figure 14:
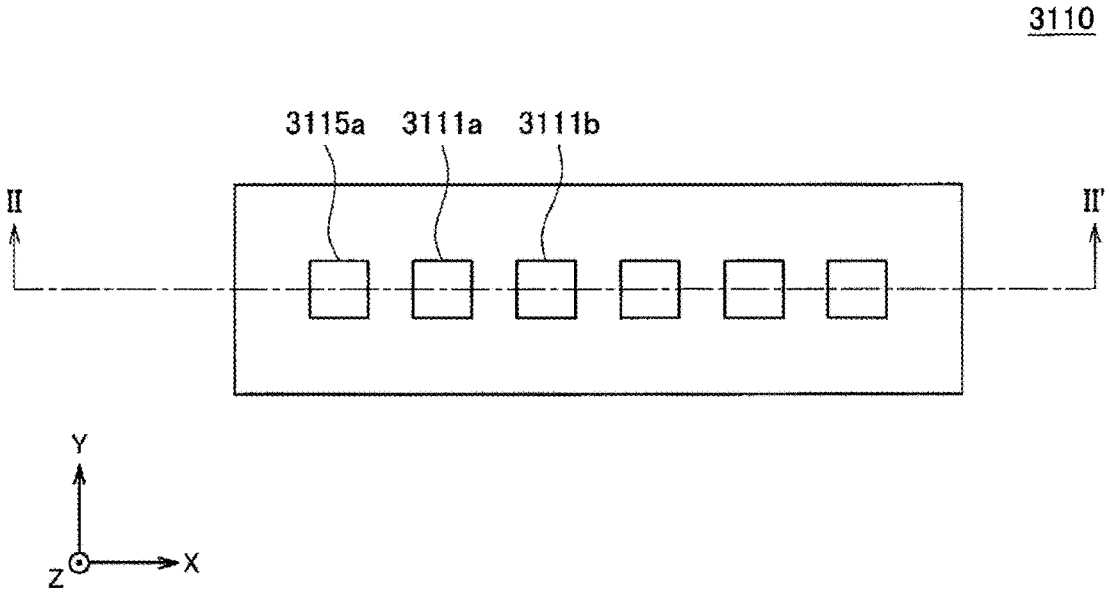
FIG. 14 is a diagram showing one example of the schematic configuration of the antenna device according to the embodiment.

Subsequently, the characteristics of the antenna device 3110 according to the present embodiment will be described. For example, FIG. 14 is a diagram showing one example of the schematic configuration of the antenna device 3110 according to the present embodiment, and shows one example of the schematic configuration of the antenna device 3110 in a case where the antenna device 3110 is viewed from vertically above (+z direction). Note that the x direction, y direction, and z direction in FIG. 14 correspond to the x direction, y direction, and z direction in FIG. 6, respectively. Under such a configuration, a simulation of the radiation pattern has been performed, out of the plurality of antenna elements 3111, on each of the antenna element 3111*a* located on the end side in the −x direction (that is, antenna element 3111 mutually adjacent to the parasitic element 3115*a*) and the antenna element 3111*b* mutually adjacent to the antenna element 3111*a* in the +x direction.

Figure 15:
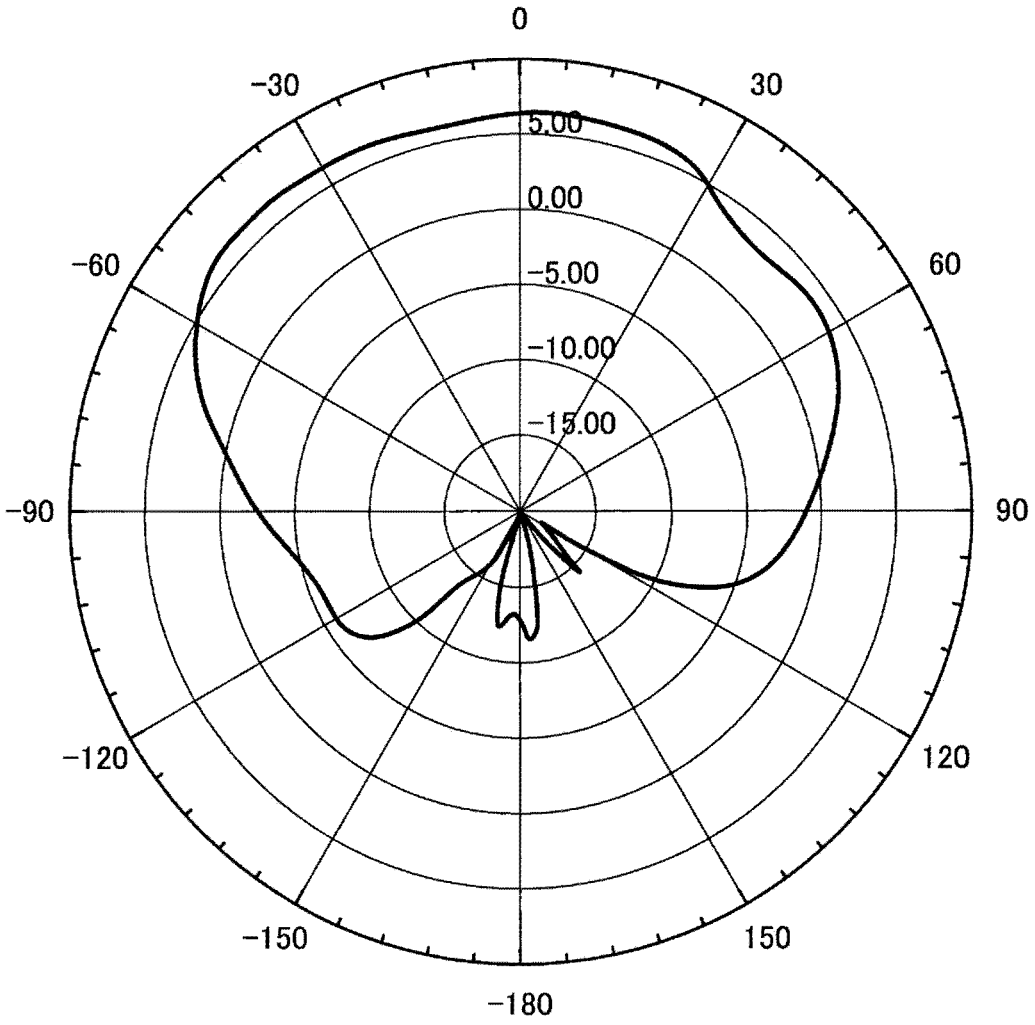
FIG. 15 is a diagram showing one example of a simulation result of a radiation pattern of an antenna element in the antenna device according to the embodiment.
Figure 16:
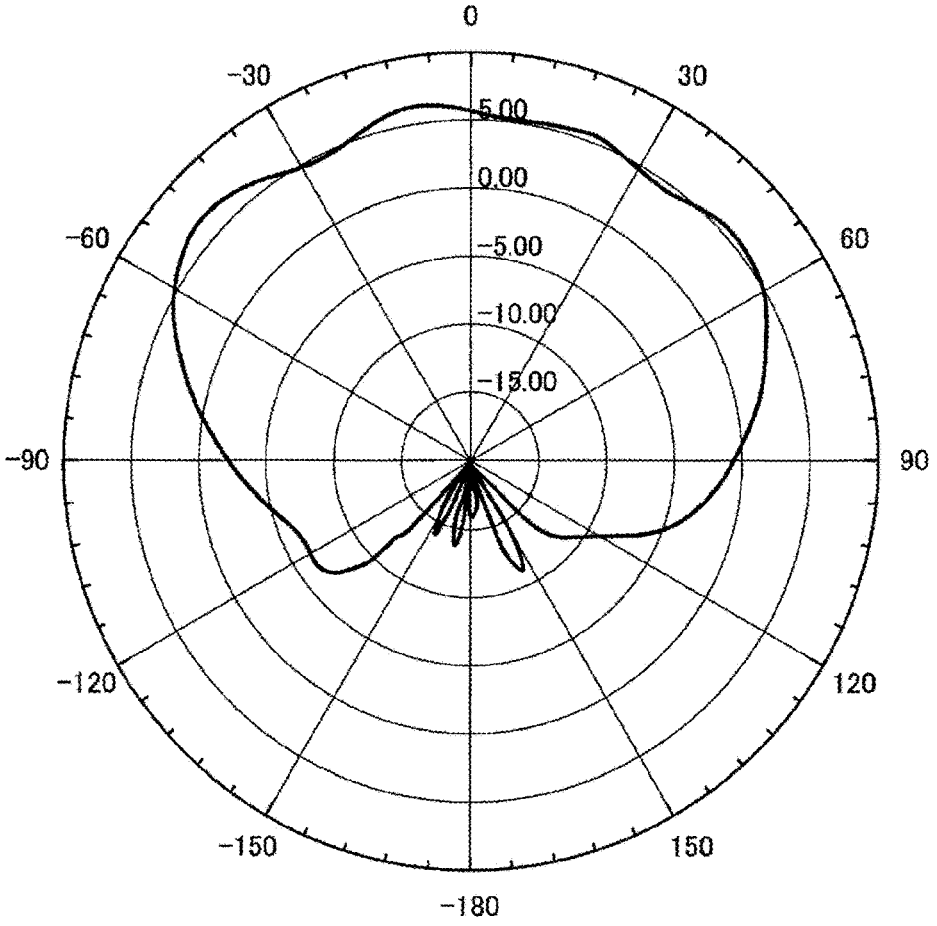
FIG. 16 is a diagram showing one example of the simulation result of the radiation pattern of the antenna element in the antenna device according to the embodiment.

For example, FIGS. 15 and 16 are each a diagram showing one example of the simulation result of the radiation pattern of the antenna element in the antenna device 3110 according to the present embodiment.

Specifically, FIG. 15 shows one example of the radiation pattern of the antenna element 3111*a* in a case where the radiation pattern is cut along the II-II' plane (xz plane) of FIG. 14. As can be seen by comparing FIG. 15 with FIG. 12, in the antenna device 3110 according to the present embodiment, the distortion on the +x direction side generated in the radiation pattern of the antenna element 3111*a* is smaller than in the antenna device 3910 according to the comparative example. That is, with the antenna device 3110 according to the present embodiment, it can be seen that symmetry of the shape of the radiation pattern of the antenna element 3111*a* in the x direction has become better than in the antenna device 3910 according to the comparative example.

Furthermore, FIG. 16 shows one example of the radiation pattern of the antenna element 3111*b* in a case where the radiation pattern is cut along the II-II' plane (xz plane) of FIG. 14. In the simulation result of the radiation pattern shown in FIG. 16, in a similar manner to the simulation result shown in FIG. 13, a distortion occurs in both the +x direction and the −x direction, and as a result, the shape of the radiation pattern of the antenna element 3111*b* is targeted in the x direction.

(Simulation Result of Reflection Characteristics)

Subsequently, as the characteristics of the antenna device according to the present embodiment, about one example of the simulation result of reflection characteristics of the antenna device, in particular, each of the antenna device 3910 according to the comparative example (see FIG. 11) and the antenna device 3110 according to the present embodiment (see FIG. 14) will be described.

Figure 17:
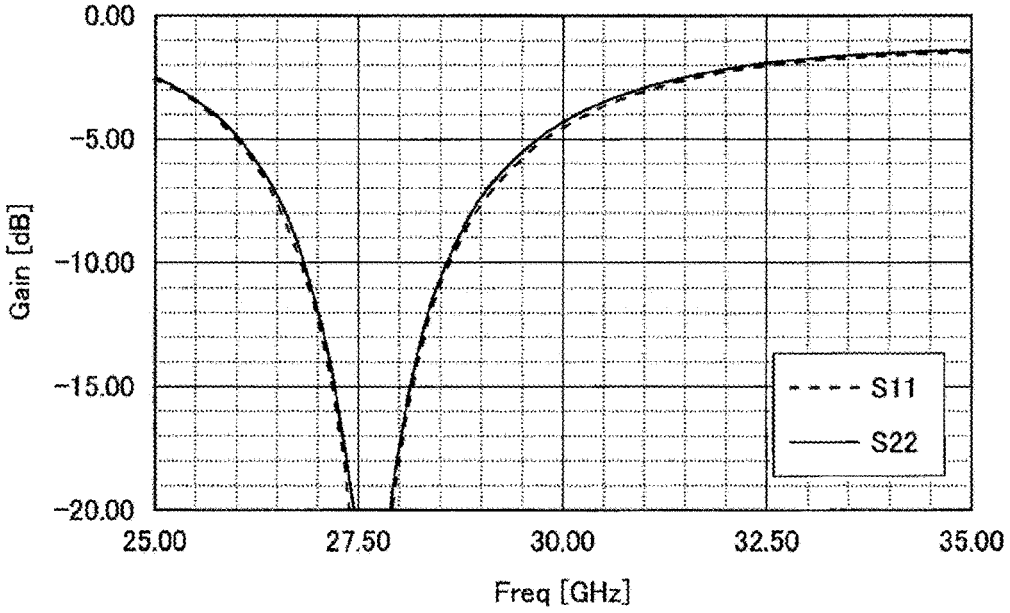
FIG. 17 is a diagram showing one example of the simulation result of reflection characteristics of the antenna device according to the comparative example.

For example, FIG. 17 is a diagram showing one example of the simulation result of the reflection characteristics of the antenna device 3910 according to the comparative example. In FIG. 17, the horizontal axis indicates frequency (GHz), and the vertical axis indicates gain (dB). Furthermore, the example shown in FIG. 17 shows the simulation result of each of S parameters S11 and S22 for the antenna elements 3111*a* and 3111*b* of the antenna device 3910 shown in FIG. 11.

Figure 18:
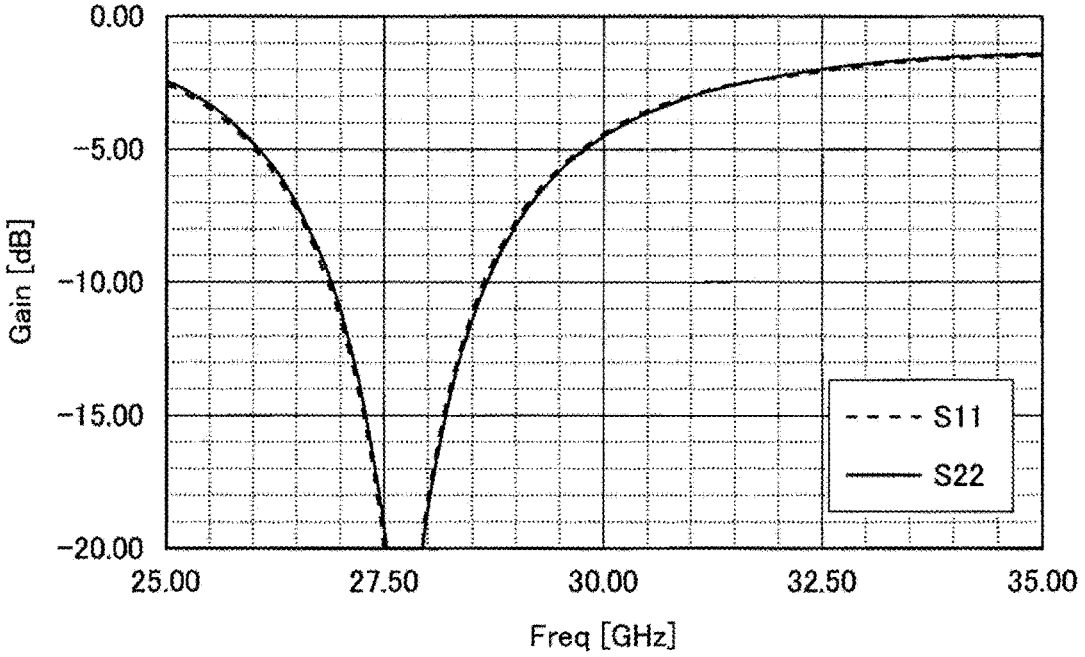
FIG. 18 is a diagram showing one example of the simulation result of reflection characteristics of the antenna device according to the embodiment.

Furthermore, FIG. 18 is a diagram showing one example of the simulation result of the reflection characteristics of the antenna device 3110 according to the present embodiment. The horizontal axis and the vertical axis in FIG. 18 are similar to the example shown in FIG. 17. Furthermore, the example shown in FIG. 18 shows the simulation result of each of S parameters S11 and S22 for the antenna elements 3111*a* and 3111*b* of the antenna device 3110 shown in FIG. 14.

As can be seen by comparing FIG. 17 with FIG. 18, there is no change in the reflection characteristics between the antenna device 3110 according to the present embodiment and the antenna device 3910 according to the comparative example. This indicates that even if the parasitic element 3115 is provided as in the antenna device 3110 according to the present embodiment, the reflection characteristics of the antenna device are not affected.

The simulation result of the characteristics of the antenna device according to the present embodiment has been described above with reference to FIGS. 11 to 18.

<5.3. Modifications>

Subsequently, modifications of the antenna device according to the present embodiment will be described.

(First Modification)

Figure 19:
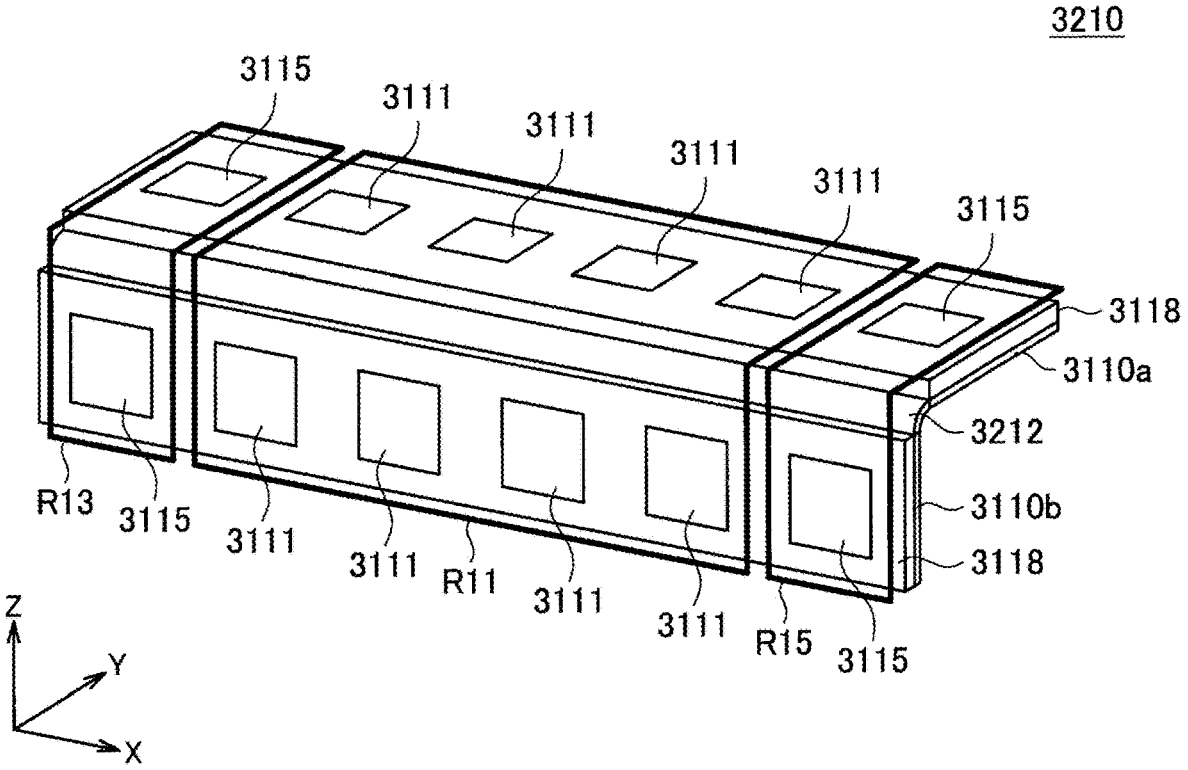
FIG. 19 is an explanatory diagram for describing one example of a configuration of an antenna device according to a first modification.

To begin with, as a first modification, one example in a case where one antenna device is configured by connecting two antenna devices in an L-shape will be described. For example, FIG. 19 is an explanatory diagram for describing one example of the configuration of the antenna device according to the first modification, and is a schematic perspective view of the antenna device. Note that in the following description, the antenna device shown in FIG. 19 may be referred to as "antenna device 3210" in order to distinguish the antenna device from other antenna devices.

As shown in FIG. 19, an antenna device 3250 includes antenna parts 3110*a* and 3110*b*, and a connection part 3212. Each of the antenna parts 3110*a* and 3110*b* corresponds to the antenna device 3110 described with reference to FIGS. 6 and 8. Therefore, detailed description of the configuration of each of the antenna parts 3110*a* and 3110*b* will be omitted. Note that in the antenna device 3210 shown in FIG. 19, one of the antenna parts 3110*a* and 3110*b* corresponds to one example of "first antenna part", and the other corresponds to one example of "second antenna part." That is, the dielectric substrate 3118 of the first antenna part corresponds to one example of "first substrate", and the dielectric substrate 3118 of the second antenna part corresponds to one example of "second substrate."

As shown in FIG. 19, the antenna parts 3110*a* and 3110*b* are placed such that, out of ends of the antenna parts 3110*a* and 3110*b*, one of the ends extending in the arrangement direction of the plurality of antenna elements 3111 is located near each other. At this time, the antenna element 3111 of the antenna part 3110*a* and the antenna element 3111 of the antenna part 3110*b* are placed such that the normal directions of the flat elements intersect each other (for example, orthogonal), or the normal directions are at positions twisted around each other. Furthermore, the connection part 3212 is provided to be constructed between ends of the antenna part 3110*a* and the antenna part 3110*b* located near each other. The antenna part 3110*a* and the antenna part 3110*b* are connected by the connection part 3212. That is, the antenna part 3110*a* and the antenna part 3110*b* are held by the connection part 3212 such that the antenna part 3110*a* and the antenna part 3110*b* form a substantial L-shape.

With such a configuration, in the antenna device 3210, the plurality of antenna elements 3111 constituting the array antenna is disposed in the area indicated by a reference sign R11, and the parasitic element 3115 is disposed in the area indicated by reference signs R13 and R15.

The antenna device 3210 having the above-described configuration is preferably held along a plurality of surfaces (outer surfaces) of the outer surface of the housing 209 of the communication device 211 that are connected to each other, for example, like the rear surface 201 and the end surface 204 of the communication device 211 shown in FIG. 3. With such a configuration, a wireless signal arriving from a direction substantially perpendicular to each of the plurality of surfaces connected to each other can be transmitted or received in a more preferred mode.

Note that as a configuration corresponding to the antenna parts 3110*a* and 3110*b* constituting the L-shaped antenna device 3210, it is also possible to apply the antenna device 3130 described with reference to FIG. 9 and the antenna device 3150 described with reference to FIG. 10.

Figure 20:
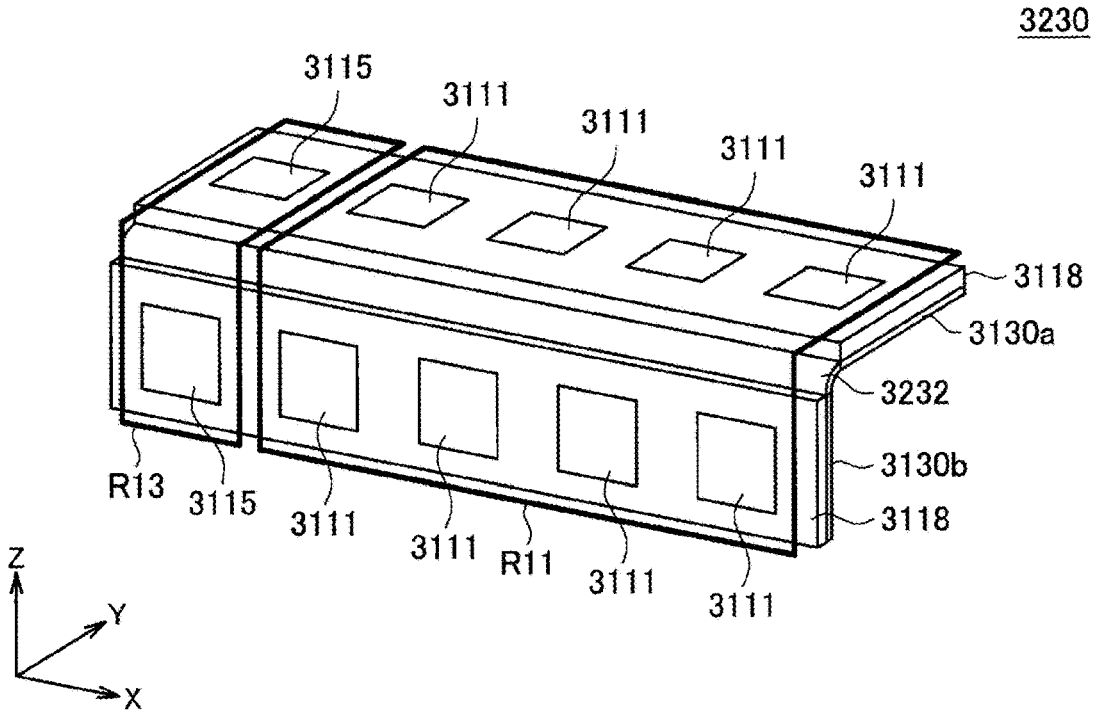
FIG. 20 is an explanatory diagram for describing another example of the configuration of the antenna device according to the first modification.

For example, FIG. 20 is an explanatory diagram for describing another example of the configuration of the antenna device according to the first modification. Note that in the following description, the antenna device shown in FIG. 20 may be referred to as "antenna device 3230" in order to distinguish the antenna device from other antenna devices.

The antenna device 3230 shown in FIG. 20 has a configuration corresponding to the antenna parts 3110*a* and 3110*b* in the antenna device 3210 shown in FIG. 19, and corresponds to one example in a case where the antenna device 3130 shown in FIG. 9 is applied. That is, the antenna parts 3130*a* and 3130*b* shown in FIG. 20 correspond to the antenna device 3130 shown in FIG. 9. Furthermore, on the basis of an idea similar to the antenna device 3210 shown in FIG. 19, connection of the antenna parts 3130*a* and 3130*b* by the connection part 3232 constitutes the L-shaped antenna device 3230.

With such a configuration, in the antenna device 3230, the plurality of antenna elements 3111 constituting the array antenna is disposed in the area indicated by the reference sign R11, and the parasitic element 3115 is disposed in the area indicated by the reference sign R13.

Furthermore, in the antenna device 3230 shown in FIG. 20, one of the antenna parts 3130*a* and 3130*b* corresponds to one example of "first antenna part", and the other corresponds to one example of "second antenna part." That is, the dielectric substrate 3118 of the first antenna part corresponds to one example of "first substrate", and the dielectric substrate 3118 of the second antenna part corresponds to one example of "second substrate."

Figure 21:
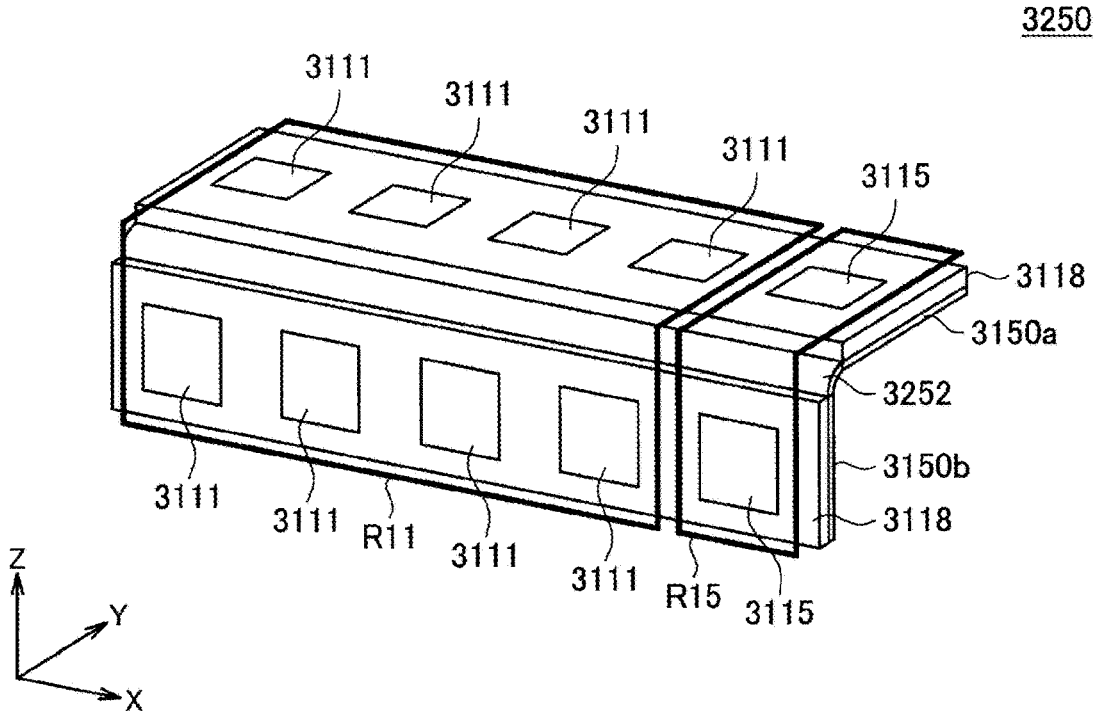
FIG. 21 is an explanatory diagram for describing another example of the configuration of the antenna device according to the first modification.

For example, FIG. 21 is an explanatory diagram for describing another example of the configuration of the antenna device according to the first modification. Note that in the following description, the antenna device shown in FIG. 21 may be referred to as "antenna device 3250" in order to distinguish the antenna device from other antenna devices.

The antenna device 3250 shown in FIG. 21 has a configuration corresponding to the antenna parts 3110*a* and 3110*b* in the antenna device 3210 shown in FIG. 19, and corresponds to one example in a case where the antenna device 3150 shown in FIG. 10 is applied. That is, the antenna parts 3150*a* and 3150*b* shown in FIG. 21 correspond to the antenna device 3530 shown in FIG. 10. Furthermore, on the basis of an idea similar to the antenna device 3210 shown in FIG. 19, connection of the antenna parts 3150*a* and 3150*b* by the connection part 3252 constitutes the L-shaped antenna device 3250.

With such a configuration, in the antenna device 3250, the plurality of antenna elements 3111 constituting the array antenna is disposed in the area indicated by the reference sign R11, and the parasitic element 3115 is disposed in the area indicated by the reference sign R15.

Furthermore, in the antenna device 3250 shown in FIG. 21, one of the antenna parts 3150*a* and 3150*b* corresponds to one example of "first antenna part", and the other corresponds to one example of "second antenna part." That is, the dielectric substrate 3118 of the first antenna part corresponds to one example of "first substrate", and the dielectric substrate 3118 of the second antenna part corresponds to one example of "second substrate."

As the first modification, with reference to FIGS. 19 to 21, one example in a case where one antenna device is configured by connecting two antenna devices in an L-shape has been described above.

(Second Modification)

Subsequently, as a second modification, one example of the configuration of the antenna device according to the present embodiment will be described with attention particularly paid to the configuration of the array antenna.

The above-described embodiment has described a case of configuring a so-called one-dimensional array in which the plurality of antenna elements 3111 is disposed to be spaced apart from each other along the predetermined direction. Meanwhile, the arrangement of the plurality of antenna elements 3111 is not necessarily limited to only the arrangement in a case where the so-called one-dimensional array is configured as in the embodiment described above.

Figure 22:
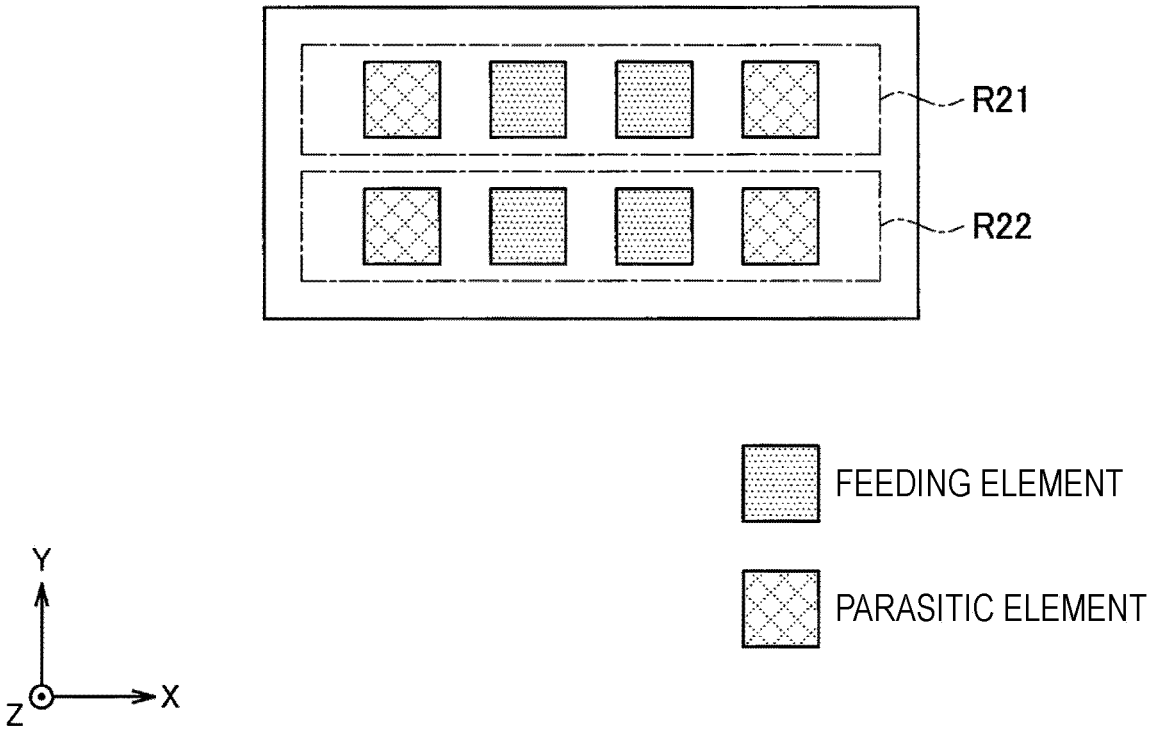
FIG. 22 is an explanatory diagram for describing one example of a configuration of an antenna device according to a second modification.
Figure 23:
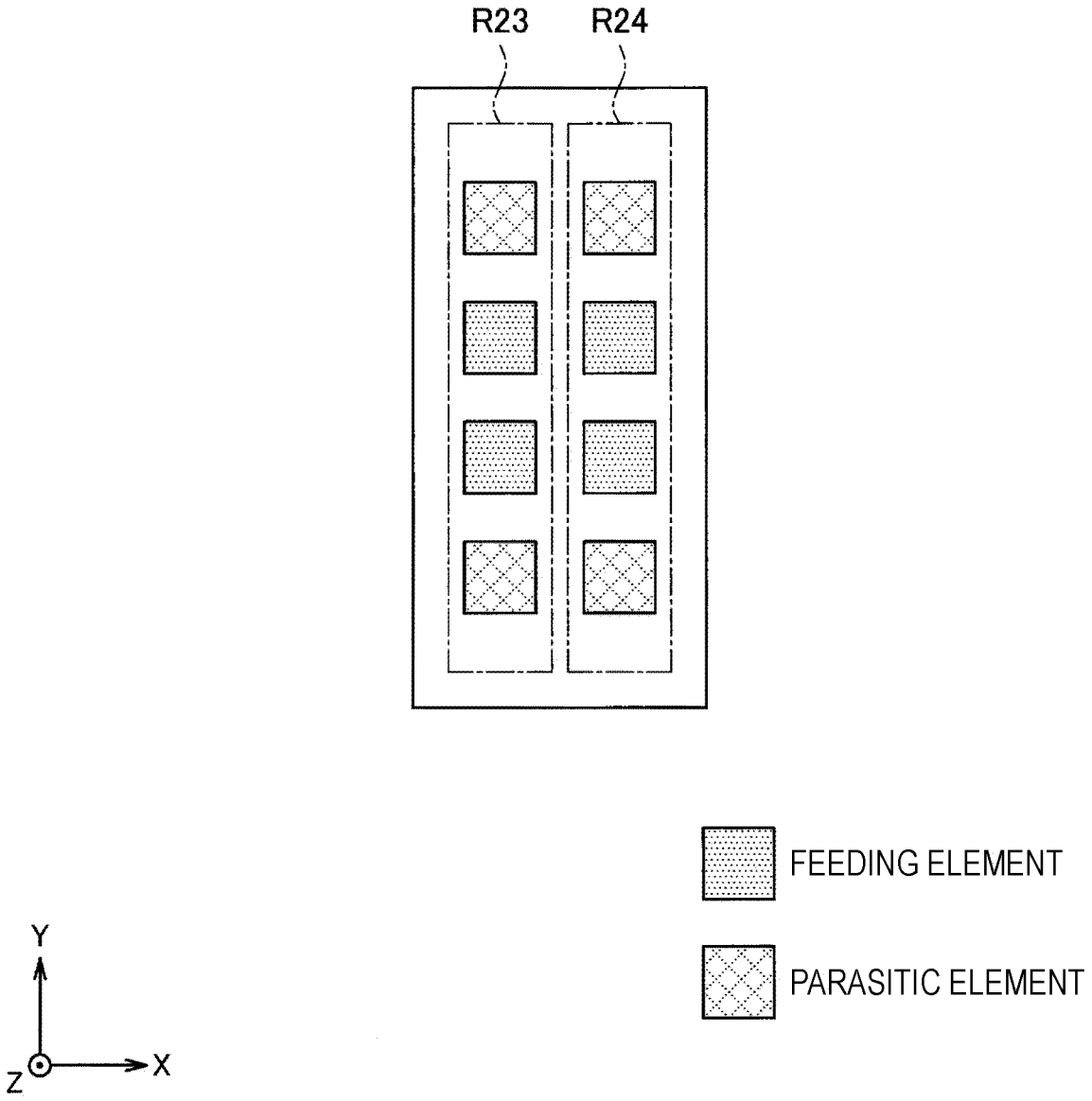
FIG. 23 is an explanatory diagram for describing one example of the configuration of the antenna device according to the second modification.
Figure 24:
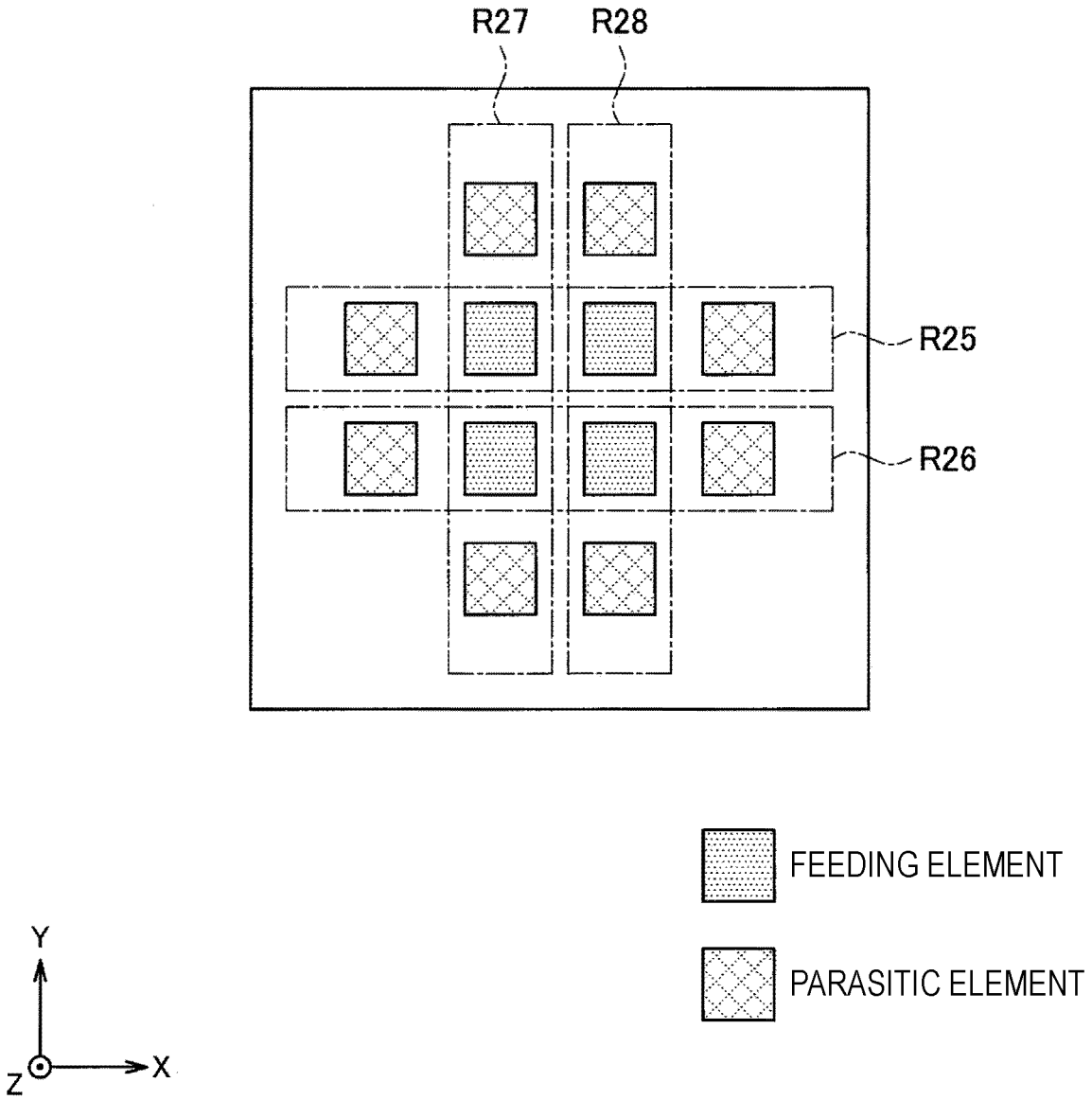
FIG. 24 is an explanatory diagram for describing one example of the configuration of the antenna device according to the second modification.

For example, FIGS. 22 to 24 are each an explanatory diagram for describing one example of the configuration of the antenna device according to the second modification, and show one example in a case where an array antenna (so-called two-dimensional array) is configured by arranging the plurality of antenna elements 3111 two-dimensionally. Note that in FIGS. 22 to 24, a part indicated as "feeding element" corresponds to the antenna element 3111 in the antenna device 3110 (that is, antenna element having a feeding point) according to the present embodiment. Furthermore, a part indicated as "parasitic element" corresponds to the parasitic element 3115 in the antenna device 3110 according to the present embodiment. Furthermore, in FIGS. 22 to 24, for convenience, the normal direction of the flat element constituting the feeding element (that is, configuration corresponding to the element 3112 of the antenna element 3111) is defined as a z direction, and directions that are orthogonal to each other and horizontal to a plane of the element are defined as an x direction and a y direction. That is, in the examples shown in FIGS. 22 to 24, a plurality of feeding elements is disposed so as to be spaced apart from each other along each of the x direction and the y direction.

To begin with, the example shown in FIG. 22 will be described. In the example shown in FIG. 22, among the feeding elements arranged two-dimensionally on an xy plane, parasitic elements are disposed so as to be mutually adjacent, in the x direction, to the feeding elements located on the end sides in the x direction. That is, in the example shown in FIG. 22, each of parts indicated by reference signs R21 and R22 has a configuration similar to the configuration of the antenna device 3110 described with reference to FIGS. 6 and 8. With such a configuration, in the example shown in FIG. 22, in each of the parts indicated by the reference signs R21 and R22, in a similar manner to the antenna device 3110, it is possible to expect effects of improving symmetry of the shape of the radiation pattern of the feeding elements (in this case, symmetry of the shape in the x direction).

Then, the example shown in FIG. 23 will be described. In the example shown in FIG. 23, among the feeding elements arranged two-dimensionally on an xy plane, parasitic elements are disposed so as to be mutually adjacent, in the y direction, to the feeding elements located on the end sides in the y direction. That is, in the example shown in FIG. 23, each of parts indicated by reference signs R23 and R24 has a configuration similar to the configuration of the antenna device 3110 described with reference to FIGS. 6 and 8. With such a configuration, in the example shown in FIG. 23, in each of the parts indicated by the reference signs R23 and R24, in a similar manner to the antenna device 3110, it is possible to expect effects of improving symmetry of the shape of the radiation pattern of the feeding elements (in this case, symmetry of the shape in the y direction).

Then, the example shown in FIG. 24 will be described. In the example shown in FIG. 24, among the feeding elements arranged two-dimensionally on an xy plane, in each of the x direction and the y direction, parasitic elements are disposed so as to be mutually adjacent to the feeding elements located on the end sides in the direction. That is, in the example shown in FIG. 24, each of parts indicated by reference signs R25 and R26 has a configuration similar to the configuration of the antenna device 3110 described with reference to FIGS. 6 and 8. With such a configuration, in the example shown in FIG. 24, in each of the parts indicated by the reference signs R25 and R26, in a similar manner to the antenna device 3110, it is possible to expect effects of improving symmetry of the shape of the radiation pattern of the feeding elements (in this case, symmetry of the shape in the x direction). Similarly, in the example shown in FIG. 24, each of parts indicated by reference signs R27 and R28 has a configuration similar to the configuration of the antenna device 3110. With such a configuration, in the example shown in FIG. 25, in each of the parts indicated by the reference signs R27 and R28, in a similar manner to the antenna device 3110, it is possible to expect effects of improving symmetry of the shape of the radiation pattern of the feeding elements (in this case, symmetry of the shape in the y direction).

Figure 25:
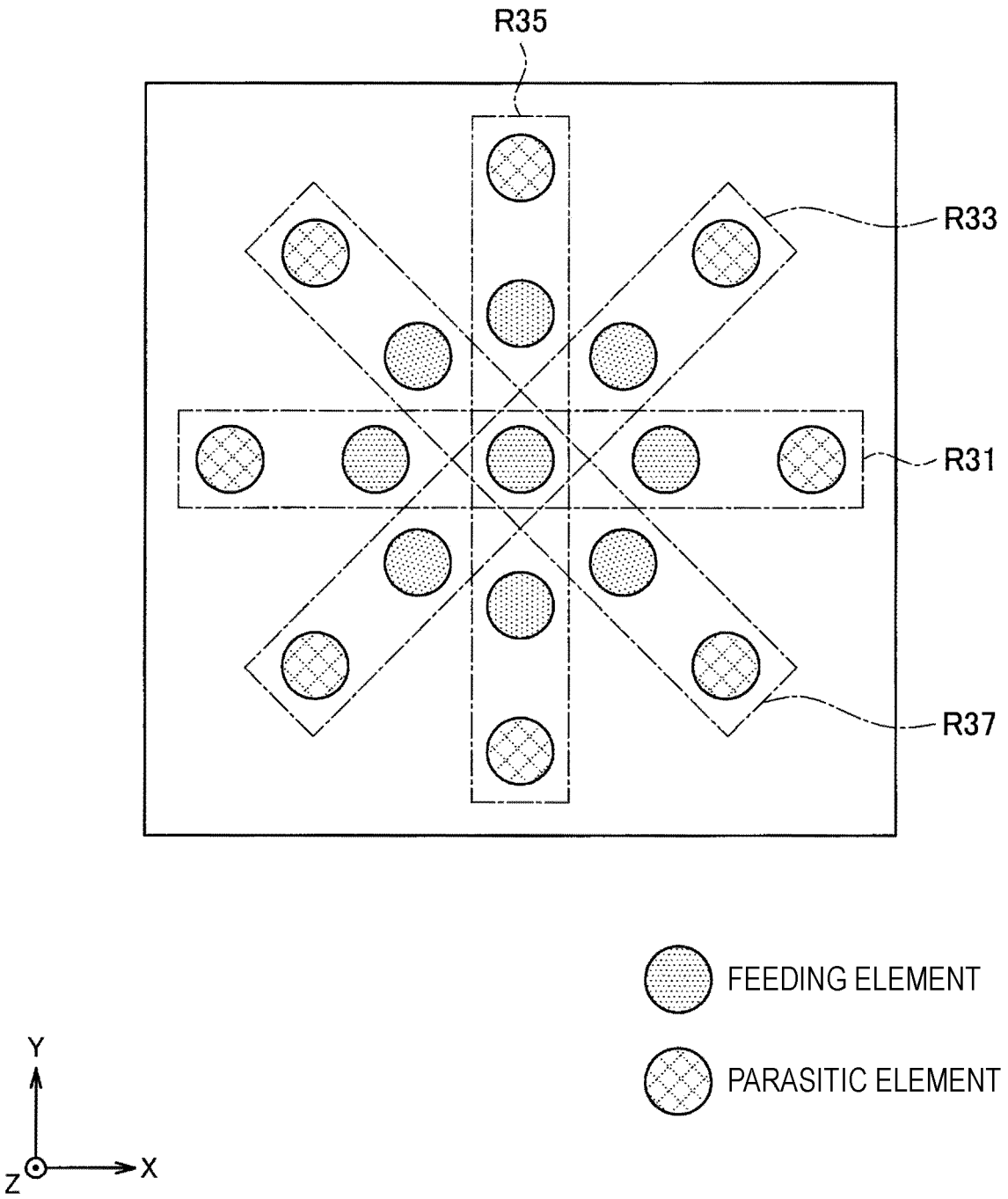
FIG. 25 is an explanatory diagram for describing one example of the configuration of the antenna device according to the second modification.

Furthermore, FIG. 25 is an explanatory diagram for describing one example of the configuration of the antenna device according to the second modification, and show one example in a case where an array antenna (so-called radial array) is configured by arranging the plurality of antenna elements 3111 radially. Note that in FIG. 25, a part indicated as "feeding element" corresponds to the antenna element 3111 in the antenna device 3110 (that is, antenna element having a feeding point) according to the present embodiment. Furthermore, a part indicated as "parasitic element" corresponds to the parasitic element 3115 in the antenna device 3110 according to the present embodiment. Furthermore, in FIG. 25, the x direction, y direction, and z direction correspond to the x direction, y direction, and z direction in the example shown in FIGS. 22 to 24, respectively. That is, in the example shown in FIG. 25, a plurality of feeding elements is disposed so as to be spaced apart from each other in the xy plane.

In the example shown in FIG. 25, among the feeding elements radially arranged on the xy plane (in other words, feeding elements arranged concentrically), for each of the plurality of feeding elements arranged in the radial direction, the parasitic elements are disposed so as to be mutually adjacent, in the radial direction, to the feeding elements located on the end sides in the radial direction. That is, in the example shown in FIG. 25, each of parts indicated by reference signs R31 to R37 has a configuration similar to the configuration of the antenna device 3110 described with reference to FIGS. 6 and 8. With such a configuration, in the example shown in FIG. 25, in each of the parts indicated by the reference signs R31 to R37, in a similar manner to the antenna device 3110, it is possible to expect effects of improving symmetry of the shape of the radiation pattern of the feeding elements (in this case, symmetry of the shape in the radial direction).

Note that the examples shown in FIGS. 22 to 25 are just one example, and do not necessarily limit the configuration of the antenna device 3110 according to the present embodiment. That is, the configuration of the antenna device according to the present embodiment is not particularly limited if parasitic elements are disposed on the basis of the above-described idea, for at least some two or more antenna elements arranged along a desired direction among the plurality of antenna elements constituting the array antenna.

Furthermore, the shape of the feeding element and the parasitic element is not particularly limited, and may be, for example, a circle, a square, and the like. Therefore, as the feeding element, for example, antenna elements including an E-type patch antenna, a patch antenna with a slot, a patch antenna with a circularly-polarized perturbation element, and the like can be applied. Furthermore, the shape of the parasitic element may be set according to the antenna element applied as the feeding element. Furthermore, as another example, the shape of the feeding element or the parasitic element may be determined according to an arrangement pattern of the plurality of feeding elements constituting the array antenna constituting the antenna device. This is not limited to the present modification, but is also similar for the embodiment and other modifications described above.

As the second modification, with reference to FIGS. 22 to 25, one example of the configuration of the antenna device according to the present embodiment has been described above with attention particularly paid to the configuration of the array antenna.

(Third Modification)

Subsequently, as a third modification, another example of the configuration of the antenna device according to the present embodiment will be described.

The embodiment and the modifications described above have described one example in a case where the substrate on which the antenna element and the parasitic element are disposed is formed in a flat shape. Meanwhile, if it is possible to dispose the antenna element and the parasitic element described above, the shape of the substrate on which the antenna element and the parasitic element are disposed (that is, configuration corresponding to the above-described substrate) is not necessarily limited to a flat shape.

Figure 26:
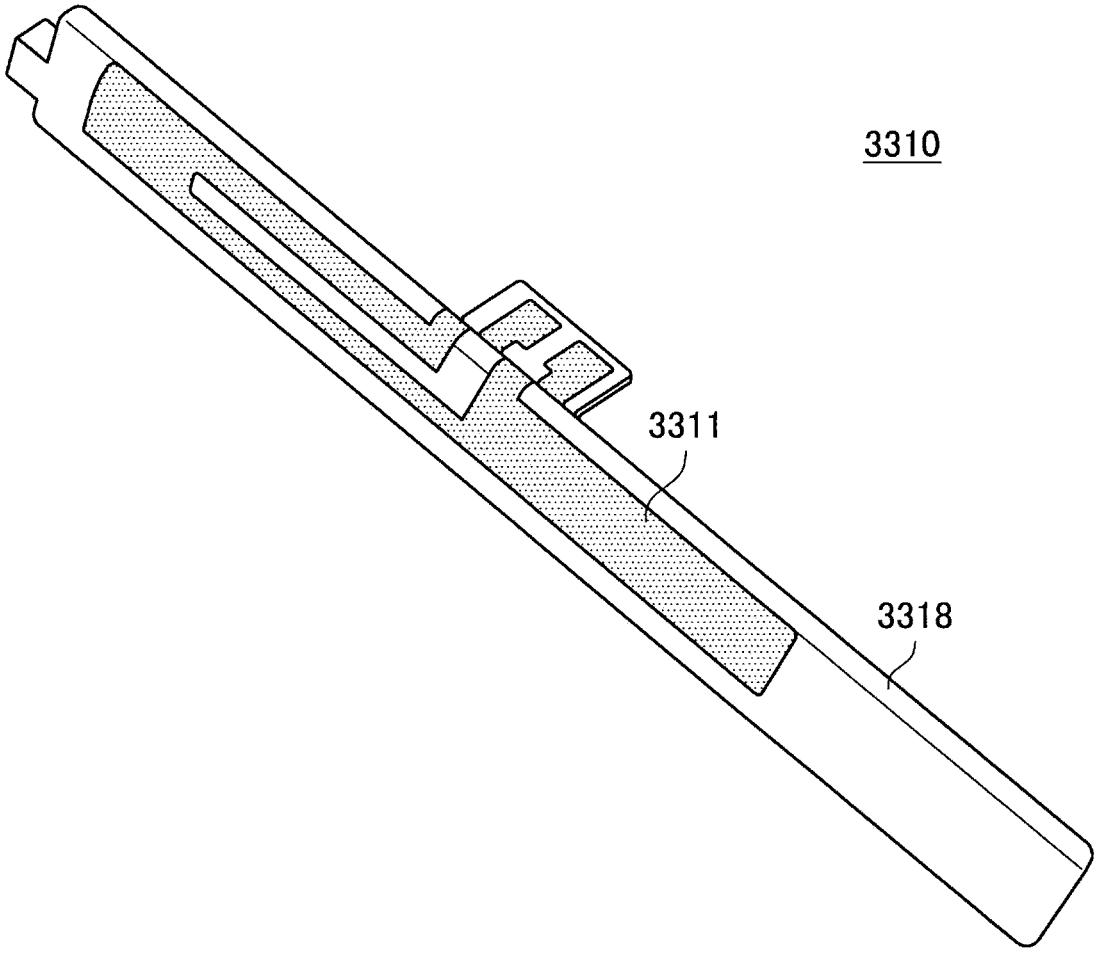
FIG. 26 is an explanatory diagram for describing one example of a configuration of an antenna device according to a third modification.
Figure 27:
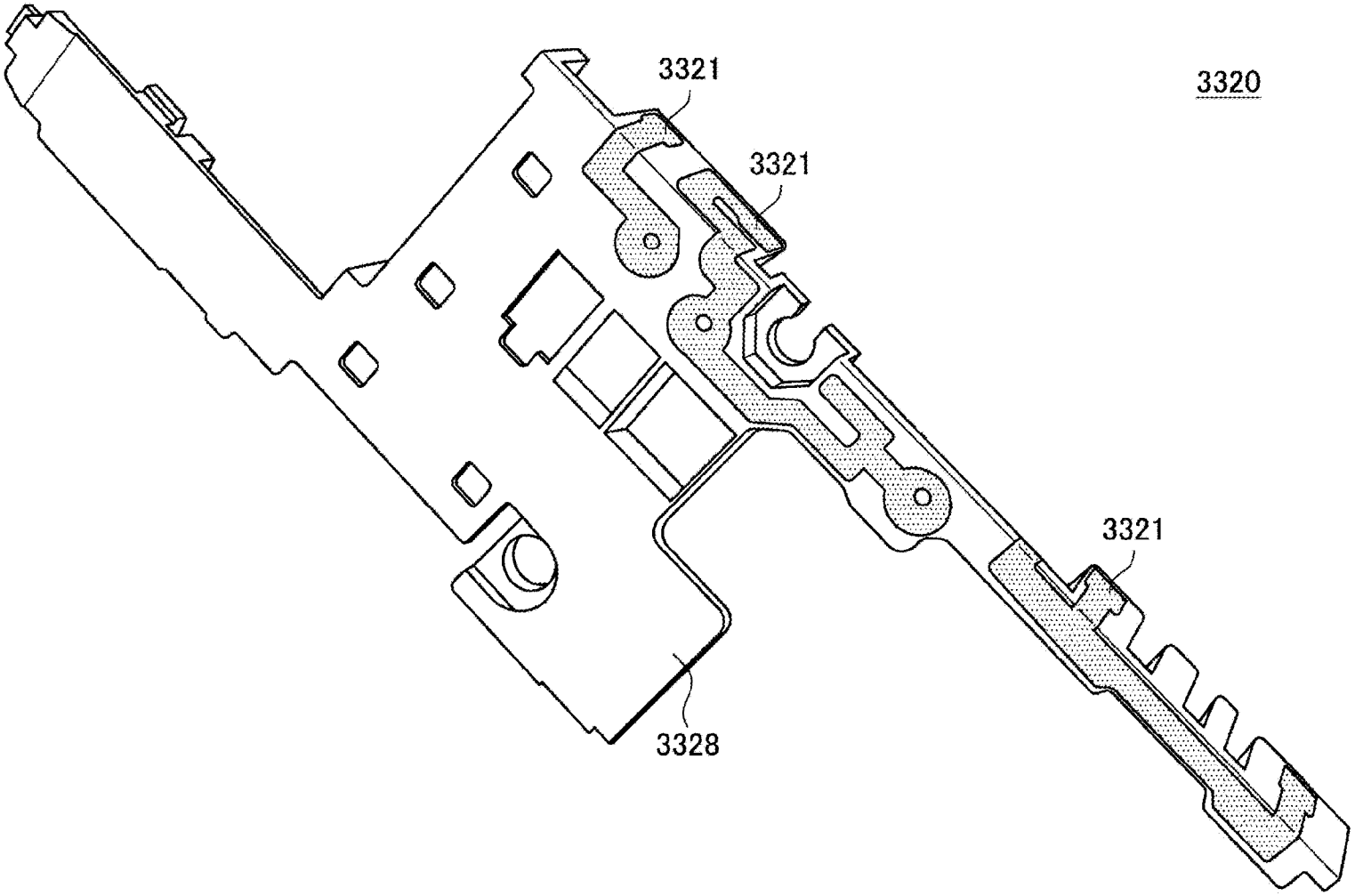
FIG. 27 is an explanatory diagram for describing one example of the configuration of the antenna device according to the third modification.

For example, FIGS. 26 and 27 are each an explanatory diagram for describing one example of a configuration of an antenna device according to the third modification. The examples shown in FIGS. 26 and 27 show one example in a case where an antenna element is disposed on a resin frame formed as some member of a desired mechanism (for example, mechanical frame).

Specifically, in the antenna device 3310 shown in FIG. 26, a reference sign 3318 indicates a resin frame, and a reference sign 3311 indicates an antenna element. That is, in the example shown in FIG. 26, the antenna element and the parasitic element (for example, antenna element 3111 and parasitic element 3115 shown in FIG. 6) may be disposed in an area where the antenna element 3311 is disposed in the resin frame 3318 in order to be substantially similar to the embodiment and the modifications described above. That is, in the example shown in FIG. 26, the resin frame 3318 corresponds to the "substrate" in the embodiment and the modifications.

Furthermore, in an antenna device 3320 shown in FIG. 27, a reference sign 3328 indicates a resin frame and a reference sign 3321 indicates an antenna element. That is, in the example shown in FIG. 27, the antenna element and the parasitic element (for example, antenna element 3111 and parasitic element 3115 shown in FIG. 6) may be disposed in an area where the antenna element 3321 is disposed in the resin frame 3328 in order to be substantially similar to the embodiment and the modifications described above. That is, in the example shown in FIG. 26, the resin frame 3318 corresponds to the "substrate" in the embodiment and the modifications.

As described above, in the antenna device according to the present embodiment, the configuration corresponding to the substrate on which the antenna element and the parasitic element are disposed is not necessarily limited to a flat shape, and the configuration may have a three-dimensional shape as shown in FIGS. 26 and 27, for example. That is, the part described as "substrate" in the present disclosure is not limited to only a flat substrate, but also includes a base material on which the antenna element can be disposed, like the resin frame described above (for example, a base material having a three-dimensional shape).

As the third modification, another example of the configuration of the antenna device according to the present embodiment has been described above.

<5.4. Application Example>

Subsequently, as an application example of the communication device to which the antenna device according to one embodiment of the present disclosure is applied, one example of applying the technology according to the present disclosure to devices other than a communication terminal such as a smartphone will be described.

In recent years, the technology of connecting various things to a network, which is called internet of things (IoT), has attracted attention. It is assumed that devices other than smartphones and tablet terminals can be used for communication. Therefore, for example, application of the technology according to the present disclosure to movably configured various devices enables the devices to perform communication using a millimeter wave.

Figure 28:
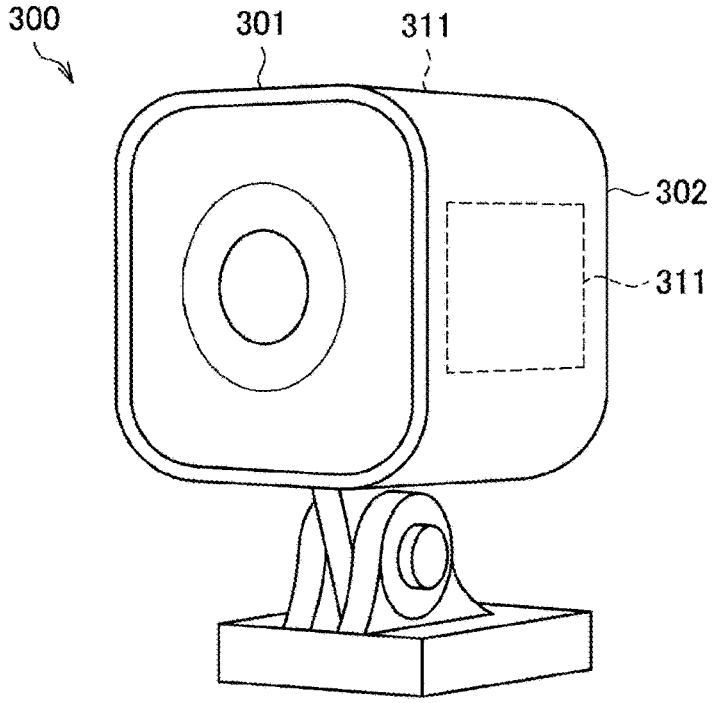
FIG. 28 is an explanatory diagram for describing an application example of the communication device according to the embodiment.

For example, FIG. 28 is an explanatory diagram for describing an application example of a communication device according to the present embodiment, and shows one example in a case where the technology according to the present disclosure is applied to a camera device. Specifically, in the example shown in FIG. 28, the antenna device according to one embodiment of the present disclosure is held so as to be located near each of surfaces 301 and 302 facing directions different from each other, out of outer surfaces of a housing of a camera device 300. For example, a reference sign 311 schematically shows the antenna device according to one embodiment of the present disclosure. With such a configuration, for example, in each of the surfaces 301 and 302, the camera device 300 shown in FIG. 28 can transmit or receive a wireless signal that propagates in a direction that substantially agrees with the normal direction of the surface. Note that it is needless to say that the antenna device 311 may be provided not only on the surfaces 301 and 302 shown in FIG. 28 but also on other surfaces.

Figure 29:
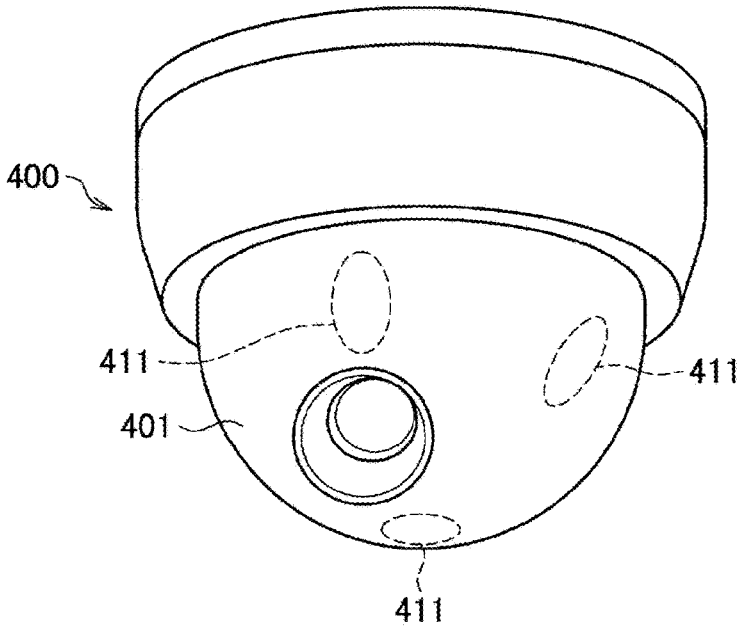
FIG. 29 is an explanatory diagram for describing an application example of the communication device according to the embodiment.

Furthermore, the technology according to the present disclosure can be applied to an unmanned aerial vehicle called a drone, and the like. For example, FIG. 29 is an explanatory diagram for describing an application example of the communication device according to the present embodiment, and shows one example in a case where the technology according to the present disclosure is applied to a camera device installed on a bottom of a drone. Specifically, it is preferable that a drone flying at a high altitude can mainly transmit or receive a wireless signal (millimeter wave) coming from various directions on the lower side. Therefore, for example, in the example shown in FIG. 29, the antenna device according to one embodiment of the present disclosure is held so as to be located near respective portions facing directions different from each other, out of an outer surface 401 of a housing of a camera device 400 installed on the bottom of the drone. For example, a reference sign 411 schematically shows the antenna device according to one embodiment of the present disclosure. Furthermore, although illustration is omitted in FIG. 29, the antenna device 411 may be provided not only in the camera device 400 but also, for example, in respective portions of the housing of the drone itself. Also in this case, in particular, the antenna device 411 is preferably provided on the lower side of the housing.

Note that as shown in FIG. 29, in a case where at least part of outer surfaces of the housing of the target device is configured as a curved surface (that is, surface having curvature), out of respective partial areas in the curved surface, the antenna device 411 is preferably held near each of the plurality of partial areas where the normal directions intersect each other or the normal directions are at positions twisted around each other. With such a configuration, the camera device 400 shown in FIG. 29 can transmit or receive a wireless signal that propagates in a direction that substantially agrees with the normal direction of each partial area.

Note that the example described with reference to FIGS. 28 and 29 is merely one example, and a device to which the technology according to the present disclosure is applied is not particularly limited as long as the device performs communication using a millimeter wave.

As described above, as the application example of the communication device to which the antenna device according to one embodiment of the present disclosure is applied, with reference to FIGS. 28 and 29, one example of applying the technology according to the present disclosure to devices other than a communication terminal such as a smartphone has been described.

6. CONCLUSION

As described above, the antenna device according to the present embodiment includes a substrate (dielectric substrate), a plurality of antenna elements each having a feeding point, and a parasitic element having no feeding point. Each of the plurality of antenna elements and the parasitic element are supported by the substrate. Specifically, the plurality of antenna elements is disposed so as to be spaced apart from each other along a predetermined direction. At this time, the plurality of antenna elements constitutes an array antenna. Furthermore, among the plurality of antenna elements described above, the parasitic element is disposed so as to be mutually spaced apart, in an arrangement direction, from a first antenna element located on the end side of the arrangement direction of the plurality of antenna elements. That is, the parasitic element is disposed so as to be mutually adjacent to the first antenna element in the arrangement direction described above. Furthermore, a first element interval between the parasitic element described above and the first antenna element described above is equal to or less than twice a second element interval between the first antenna element and a second antenna element located on the opposite side of the parasitic element with respect to the first antenna element.

With the above configuration, the antenna device according to the present embodiment makes it possible to reduce the influence of the distortion that occurs in the radiation pattern of the first antenna element described above, and to secure symmetry of the radiation pattern in the arrangement direction described above. Furthermore, the antenna device according to the present embodiment makes it possible to make the size in the arrangement direction smaller than in a case where symmetry of the radiation pattern described above in the arrangement direction described above is secured without providing a parasitic element. That is, the antenna device according to the present embodiment enables both securing symmetry of the radiation pattern of each antenna element (particularly, antenna element located on the end side in the arrangement direction) and miniaturizing the antenna device in a more preferred mode in a case where the plurality of antenna elements is arrayed.

The preferred embodiment of the present disclosure has been described in detail above with reference to the accompanying drawings, but the technical scope of the present disclosure is not limited to such an example. It is obvious that persons of ordinary skill in the technical field of the present disclosure can conceive various modifications or alterations within the scope of the technical idea described in the claims, and it is of course understood that these also fall within the technical scope of the present disclosure.

Furthermore, effects described in the present specification are merely descriptive or illustrative and not restrictive. That is, the technology according to the present disclosure can produce other effects obvious to those skilled in the art from the description in the present specification, in addition to or instead of the effects described above.

Note that the following configurations also belong to the technical scope of the present disclosure.

(1)

An antenna device including:

a substrate;

a plurality of antenna elements supported by the substrate, each of the antenna elements having a feeding point; and a parasitic element supported by the substrate and having no feeding point, in which the plurality of antenna elements is disposed to be spaced apart from each other along a predetermined direction, the parasitic element is mutually spaced apart in the direction from a first antenna element located on an end side in the direction among the plurality of antenna elements, and a first element interval between the parasitic element and the first antenna element is equal to or less than twice a second element interval between the first antenna element and a second antenna element located on an opposite side of the parasitic element with respect to the first antenna element.

(2)

The antenna device according to (1) described above, in which the parasitic element is disposed at a position symmetrical to the second antenna element with respect to the first antenna element.

(3)

The antenna device according to (1) or (2) described above, in which the first element interval is equal to or less than a wavelength of a wireless signal transmitted or received by the plurality of antenna elements.

(4)

The antenna device according to (3) described above, in which the first element interval is substantially equal to a half of the wavelength.

(5)

The antenna device according to any one of claims (1) to (4) described above, in which a first width of the parasitic element along the direction is substantially equal to a second width of each of the antenna elements along the direction.

(6)

The antenna device according to (5) described above, in which the first width d1 satisfies a conditional expression shown below, in a case where a relative permittivity of a resin frame of the antenna elements is εr, and a wavelength of a wireless signal transmitted or received by the plurality of antenna elements is λ.

[Equation 5]

$$d1 = \frac{\lambda}{2\sqrt{\varepsilon r}}$$

(7)

The antenna device according to (6) described above, in which the first width is substantially equal to λ/4.

(8)

The antenna device according to any one of claims (1) to (7) described above, in which the parasitic element is used as a pad for a predetermined sensor.

(9)

The antenna device according to any one of claims (1) to (7) described above, in which the parasitic element has a shape substantially identical to a shape of each of the antenna elements.

(10)

The antenna device according to (9) described above, in which each of the antenna elements has a configuration as a patch antenna, an E-type patch antenna, a patch antenna with a slot, or a patch antenna with a circularly polarized perturbation element.

(11)

The antenna device according to any one of claims (1) to (10) described above, in which the plurality of antenna elements is at least a part of antenna elements constituting an array antenna in which a plurality of antenna elements is disposed in one or more directions.

(12)

The antenna device according to (11) described above, in which the array antenna is a one-dimensional array antenna, a two-dimensional array antenna, or a radial array antenna.

(13)

The antenna device according to any one of claims (1) to (12) described above, further including, as the substrate, a first substrate and a second substrate each supporting the plurality of antenna elements and the parasitic element, in which the first substrate and the second substrate are each held such that normal directions intersect each other or the normal directions are at positions twisted around each other.

REFERENCE SIGNS LIST

200 Terminal device
2001 Antenna part
2003 Wireless communication unit
2005 Communication control unit
2007 Storage unit
211 Communication device
3110 Antenna device
3111 Antenna element
3112 Element
3113 Feeding point
3115 Parasitic element
3116 Element
3118 Dielectric substrate
3119 Ground plate
3210 Antenna device
3110*a*, 3110*b* Antenna part
3212 Connection part

The invention claimed is:

1. An antenna device comprising:

a substrate;

a plurality of antenna elements supported by the substrate, each of the antenna elements having a feeding point; and a plurality of parasitic elements supported by the substrate and having no feeding point, wherein at least a first group of the plurality of antenna elements is disposed to be spaced apart from each other along a first predetermined direction, wherein at least a second group of the plurality of antenna elements is disposed to be spaced apart from each other along a second predetermined direction perpendicular to the first predetermined direction, wherein at least a third group of the plurality of antenna elements is disposed to be spaced apart from each other along a third predetermined direction different from the first and second predetermined directions, wherein a first pair of parasitic elements among the plurality of parasitic elements is mutually spaced apart in the first predetermined direction on respective end sides of the first group of antenna elements, wherein a second pair of parasitic elements among the plurality of parasitic elements is mutually spaced apart in the second predetermined direction on respective end sides of the second group of antenna elements, wherein a third pair of parasitic elements among the plurality of parasitic elements is mutually spaced apart in the third predetermined direction on respective end sides of the third group of antenna elements, and wherein a first antenna element among the plurality of antenna elements is included in each of the first, second, and third groups of antenna elements and each pair of parasitic elements is symmetrical to the first antenna element.

2. The antenna device according to claim 1, wherein a first element interval between a parasitic element of the first pair of parasitic elements and an endmost antenna element of the first group of antenna elements is equal to or less than twice a second element interval between the endmost antenna element and a second antenna element of the first group of antenna elements closest to the endmost antenna element, and wherein the first element interval is equal to or less than a wavelength of a wireless signal transmitted or received by the plurality of antenna elements.

3. The antenna device according to claim 2, wherein the first element interval is substantially equal to a half of the wavelength.

4. The antenna device according to claim 1, wherein a first width of the plurality of parasitic elements is substantially equal to a second width of each of the plurality of antenna elements.

5. The antenna device according to claim 4, wherein the first width d1 satisfies a conditional expression shown below, in a case where a relative permittivity of a resin frame of the antenna elements is εr, and a wavelength of a wireless signal transmitted or received by the plurality of antenna elements is λ

$$d1 = \frac{\lambda}{2\sqrt{\varepsilon r}}.$$

6. The antenna device according to claim 5, wherein the first width is substantially equal to λ/4.

7. The antenna device according to claim 1, wherein at least one of the plurality of parasitic elements is used as a pad for a predetermined sensor.

8. The antenna device according to claim 1, wherein each of the plurality of parasitic elements has a shape substantially identical to a shape of each of the antenna elements.

9. The antenna device according to claim 8, wherein each of the antenna elements has a configuration as a patch antenna, an E-type patch antenna, a patch antenna with a slot, or a patch antenna with a circularly polarized perturbation element.

10. The antenna device according to claim 1, wherein the plurality of antenna elements is at least a part of antenna elements constituting an array antenna in which a plurality of antenna elements is disposed in one or more directions.

11. The antenna device according to claim 10, wherein the array antenna is a two-dimensional array antenna or a radial array antenna.

12. The antenna device according to claim 1, wherein the first, second, and third group of antenna elements are in the same plane.

13. The antenna device according to claim 1, wherein a number of antenna elements in each of the first, second, and third groups of antenna elements is the same.

14. The antenna device according to claim 1, wherein a distance between each parasitic element of each pair of parasitic elements to the first antenna element is the same.

* * * * *